US006637867B2

(12) United States Patent
Sugiyama et al.

(10) Patent No.: US 6,637,867 B2
(45) **Date of Patent: *Oct. 28, 2003**

(54) LIQUID DISCHARGE HEAD, HEAD CARTRIDGE PROVIDED WITH SUCH HEAD, LIQUID DISCHARGE APPARATUS AND METHOD FOR DISCHARGING LIQUID

(75) Inventors: Hiroyuki Sugiyama, Sagamihara (JP); Hiroyuki Ishinaga, Tokyo (JP); Toshio Kashino, Chigasaki (JP); Aya Yoshihira, Yokohama (JP); Kiyomitsu Kudo, Kawasaki (JP); Yoichi Taneya, Yokohama (JP); Satoshi Shimazu, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/394,531

(22) Filed: Sep. 10, 1999

(65) Prior Publication Data

US 2003/0030701 A1 Feb. 13, 2003

(30) Foreign Application Priority Data

Sep. 14, 1998 (JP) ..... 10-260355

(51) Int. Cl.[7] ..... B41J 2/05
(52) U.S. Cl. ..... 347/65
(58) Field of Search ..... 347/65

(56) References Cited

U.S. PATENT DOCUMENTS

| | | | | |
|---|---|---|---|---|
| 4,480,259 A | 10/1984 | Kruger et al. | | |
| 4,723,129 A | 2/1988 | Endo et al. | | |
| 5,821,962 A | 10/1998 | Kudo et al. | ..... | 347/65 |
| 5,943,074 A | 8/1999 | Kashino et al. | ..... | 347/54 |

FOREIGN PATENT DOCUMENTS

| | | | | |
|---|---|---|---|---|
| EP | 721841 | * 7/1996 | ..... | 347/65 |
| EP | 721843 | 7/1996 | | |
| EP | 764528 | 3/1997 | | |
| EP | 811494 | 12/1997 | | |
| EP | 813967 | 12/1997 | | |
| EP | 882589 | 12/1998 | | |
| JP | 55-81172 | 6/1980 | | |
| JP | 61-69467 | 4/1986 | | |
| JP | 63-199972 | 8/1988 | | |

* cited by examiner

*Primary Examiner*—Judy Nguyen
*Assistant Examiner*—Michael S. Brooke
(74) *Attorney, Agent, or Firm*—Fitzpatrick, Cella, Harper & Scinto

(57) ABSTRACT

A liquid discharge head comprises a separation member for separating the discharge liquid flow paths communicated with discharge ports for discharging discharge liquid to enable discharge liquid to flow, and the bubbling liquid flow paths to enable bubbling liquid to flow, which is provided with the bubble generating areas for creating bubbles used for discharging discharge liquid from the discharge ports. This separation member is provided with the opening portions positioned to face the bubble generating areas, and displacement members provided for the separation member corresponding to the openings, having the free ends to be displaced by bubbles created on the bubble generating areas provided for the separation member. Then, with no bubbles created on the bubble generating areas, the displacement members interrupt the opening portions, and with bubbles created thereon, the free ends of the displacement members are displaced to discharge discharge liquid from the discharge ports of the head. Hence, this head can prevent discharge liquid from entering around the heat generating members at the time of bubble disappearance, and the mixture of discharge liquid and bubbling liquid when the head is left intact for a long time, while maintaining the excellent discharge efficiency by means of the displacement members thus arranged.

8 Claims, 23 Drawing Sheets

LIQUID DISCHARGE HEAD, HEAD CARTRIDGE PROVIDED WITH SUCH HEAD, LIQUID DISCHARGE APPARATUS AND METHOD FOR DISCHARGING LIQUID

BACKGROUND OF THE INVENTION

1. Field of the Invention

The present invention relates to a liquid discharge head that discharges ink and other liquid with the creation of bubbles by utilizing thermal energy. The invention also relates to a head cartridge provided with such head, a liquid discharge apparatus, and a method for discharging liquid.

The present invention is applicable to a printer that records on papers, threads, textiles, cloths, leathers, metals, plastics, glass, woods, ceramics, and other recording media, a copying machine, a facsimile equipment provided with communication system, a word processor or some other apparatuses provided with the printing unit therefor. The invention is also applicable to an industrial printing system complexly structured in combination with various processing apparatuses. Here, in the specification of the present invention, the term "record" means not only the provision of characters, graphics, and other meaningful images, but also, it means the provision of patterns or other images which do not present any particular meaning when recorded on a recording medium.

2. Related Background Art

There has been known the ink jet recording method, that is, the so-called bubble jet recording method, in which energy such as heat is given to ink to cause the change of states thereof accompanied by the abrupt voluminous changes (creation of bubbles), and then, ink is discharged from the discharge ports by the acting force based on this change of states. The ink thus discharged adheres to a recording medium for the formation of images. The recording apparatus using this bubble jet recording method is generally provided with the discharge ports for discharging ink; the ink flow paths communicated with the discharge ports; and the electrothermal transducing devices each arranged in each of the ink flow paths to serve as means for generating energy used for discharging ink as disclosed in the specifications of U.S. Pat. No. 4,723,129, and others.

In accordance with a recording method of the kind, it is possible to record high quality images at higher speeds in a lesser amount of noises. At the same time, for the head that executes this recording method, it is possible to arrange the discharge ports for discharging ink in higher density, among many other advantages, thus obtaining recorded images in higher resolution with a smaller apparatus, as well as obtaining images in colors easily. In recent years, therefore, the bubble jet recording method is widely utilized for many kinds of office equipment, such as printer, copying machine, facsimile equipment, and further, utilized for the textile printing system and others for the industrial use.

Now, along with the wider utilization of the bubble jet technologies and techniques for the products currently in use in many fields, there have been various demands increasingly more in recent years. For that matter, studies and developments have been made in order to satisfy those demands. For example, there has been proposed a method for discharging liquid which is capable of discharging ink in good condition on the basis of the stabilized bubble creation, or, form the viewpoint of higher recording, there has been proposed the improved flow path structure so as to obtain the liquid discharge head which is able to perform the higher refilling into the liquid flow paths.

As an example of such improvement, the flow path structure shown in FIGS. 27A and 27B is disclosed in the specification of Japanese Patent Application Laid-Open No. 63-199972. In this specification, an invention is disclosed in which attention is given to the back waves (the pressure directed in the direction opposite to the one toward the discharge ports, that is, the pressure directed toward the liquid chamber 54). The back waves are not the energy which are directed toward the discharge ports, and function as lost energy.

FIG. 27B shows the valve 55 positioned on the side opposite to the discharge port 18 with respect to the heat generating member 2, which is away from the bubble generating area where bubbles are created by the heat generating member 2 provided for the elemental substrate 1. In FIG. 27B, the valve 55 has its initial position as if it is adhesively bonded to the ceiling of the liquid flow path 10 by the method of manufacture that utilizes flat material or the like, and then, along with the development of a bubble, it is allowed to hang down in the liquid flow path 10. A part of the back waves is controlled by the valve 55 to suppress the energy loss.

However, it is understandable that the suppression of a part of the back waves by the valve 55 thus structured is not necessarily practical for the execution of liquid discharges. The back waves themselves are not directly related to discharges fundamentally as described earlier. At the time when the back waves are generated in the liquid flow path 10, the pressure of the bubble, which is directly related to the discharge, has already in the state that it can discharge liquid from the liquid flow path 10 as shown in FIG. 27B. Therefore, even if a part of the back waves is controlled, there is no significant influence that may be exerted on discharges.

On the other hand, heating is repeated while the heat generating member is in contact with ink for the bubble jet recording method. As a result, deposition is generated due burnt ink on the surface of the heat generating member. Depending on the kind of ink, a deposition of the kind may take place in a considerable quantity so as to make the creation of bubble unstable, and in some cases, it is made difficult to perform ink discharges in good condition. Also, it has been desired to provide a method for executing good discharges without changing the quality of liquid to be discharged even in a case where the quality of liquid used for discharge is easily deteriorated by the application of heat or in a case where it is not easy to obtain sufficient bubbling with the liquid used therefor.

From these points of view, there have been disclosed in the specifications of Japanese Patent Application Laid-Open No. 61-69467, Japanese Patent Application Laid-Open No. 55-81172, and the U.S. Pat. No. 4,480,259 the method uses the liquid (bubbling liquid) for creating bubbles by the application of heat, and the liquid (discharge liquid) which is used for discharging liquid separately so as to transfer the pressure exerted by use of the bubbling liquid to the discharge liquid for discharging that the discharge liquid. In accordance with the discloser in each of them, the discharge ink and the bubbling ink are completely separate by use of silicon rubber or some other flexible film so that the discharge liquid is not directly in contact with the heat generating members, and at the same time, the structure is arranged to transfer the pressure exerted by the bubbling liquid to the discharge liquid by the deformation of the flexible film. With the structure thus formed, it has been attained to prevent the deposition from being accumulated on the surface of the heat generating members, while enhancing the freedom of discharge liquid selection or the like.

However, with the head thus structured to completely separate the discharge liquid and the bubbling liquid, the bubbling pressure is transferred to the discharge liquid by means of the stretching deformation of the flexible film at the time of bubbling. The flexible film absorbs the bubbling pressure to a considerable extent. Also, since the amount of the displacement of the flexible film is not very large, there is a fear that the energy efficiency and the discharge power are lowered, although it becomes possible to obtain the separation effect of the discharge liquid and bubbling liquid.

Therefore, there has been proposed the liquid discharge method and liquid discharge head in which the separation wall is arranged with the provision of each movable members that faces each of the bubble generating areas, and then, the first liquid flow path for use of the discharge liquid and the second flow path for use of bubbling liquid are separated so that the free end of the movable member is displaced by the bubbling pressure to discharge liquid. With the head thus structured, it becomes possible to enhance the energy efficiency and the discharge power, and at the same time, to use the ink which is subjected to being burnt or property changes when heating is applied. Nevertheless, the following problems may be encountered in some cases when a head of the kind is used:

(1) Depending on the robustness or the shape of the movable member, the discharge liquid is allowed to be mixed on the heat generating member (into the second liquid flow path side) due to the negative pressure of the bubble when it is defamed. As a result, the burnt condition occurs or the quality of ink is changed on the heat generating member in some cases.

(2) Also, if the pressure difference takes place between the discharge liquid and the bubbling liquid or if the head is left intact for a long time, the mixture of the discharge liquid and the bubbling liquid may sometimes take place at the aperture between the first liquid flow path and the second liquid flow path.

As described above, if the burnt condition should occur on the heat generating member, the quality of ink should change, or the liquids should be mixed, the life of the heat generating member becomes shorter, and the property of ink changes. These are all the factors that may lead to the problems that the reliability of the head is lowered.

SUMMARY OF THE INVENTION

It is one of the objects of the present invention to provide a highly reliable liquid discharge head having excellent discharge efficiency, at the same time, being capable of maintaining separably the characteristics of discharge liquid and bubbling liquid, and also, to provide a head cartridge provided with such head, a liquid discharge apparatus, as well as a method for discharging liquid.

It is another object of the invention to provide a liquid discharge head capable of preventing discharge liquid from entering around the heat generating members at the time of bubble disappearance, and also, preventing discharge liquid and bubbling liquid from being mixed when the head is left intact for a long time, and also, to provide a head cartridge provided with such head, a liquid discharge apparatus, as well as a method for discharging liquid.

It is a further object of the invention to provide a liquid discharge head which comprises a separation member for separating the discharge liquid flow paths communicated with discharge ports for discharging discharge liquid to enable discharge liquid to flow, and the bubbling liquid flow paths to enable bubbling liquid to flow, being provided with the bubble generating areas for creating bubbles used for discharging discharge liquid from the discharge ports, this separation member being provided with the opening portions positioned to face the bubble generating areas, and displacement members provided for the separation member corresponding to the openings, having the free ends to be displaced by bubbles created on the bubble generating areas provided for the separation member, and then, when no bubbles are created on the bubble generating areas, the displacement members interrupt the opening portions, and when bubbles are created on the bubble generating areas, the free ends of the displacement members are displaced to discharge discharge liquid from the discharge ports of this head, and also, to provide a head cartridge provided with such head, a liquid discharge apparatus, as well as a method for discharging liquid.

In accordance with the present invention thus designed, it is possible to prevent such event from taking place as discharge liquid entering around the heat generating members at the time of bubble disappearance and the mixture of discharge liquid and bubbling liquid when the head is left intact for a long time, while maintaining the excellent discharge efficiency by means of the displacement members which are arranged to face the bubble generating areas.

BRIEF DESCRIPTION OF THE DRAWINGS

FIG. 2A is an exploded sectional view which illustrates the positioning and fixing processes of the separation wall; and FIG. 2B is a side view showing the separation wall.

FIG. 4A shows the example in which a magnet is arranged underneath the heat generating member to cover the entire area of the movable member in the width direction; and FIG. 4B shows the example in which the magnet is arranged only directly underneath the interrupting portion.

FIG. 5A is the upper surface view showing one flow path of the head; FIG. 5B is the side sectional view of the head taken along in the flow path direction; and FIG. 5C is a cross-sectional view taken along line 5C—5C in FIG. 5A.

FIG. 6A is the side sectional view showing one flow path of the head; FIG. 6B is the upper surface view thereof; and FIG. 6C is the upper surface view which shows the variational example of the fifth embodiment.

DETAILED DESCRIPTION OF THE PREFERRED EMBODIMENTS

[The Description of Principles]

Now, hereunder, the principles of discharge applicable to the present invention will be described in detail.

Figure 9A:
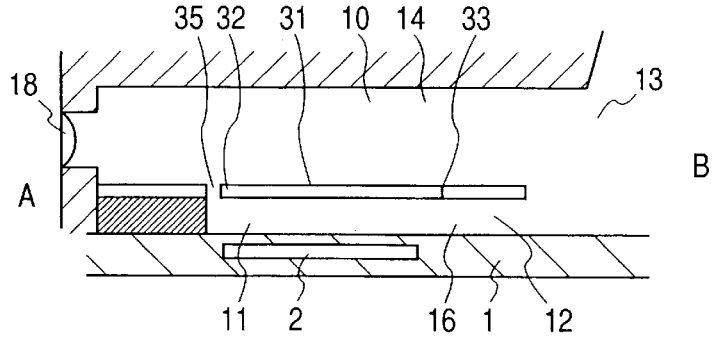
FIGS. 9A, 9B, 9C and 9D are side sectional views which illustrate one example of a liquid discharge head.
Figure 9B:
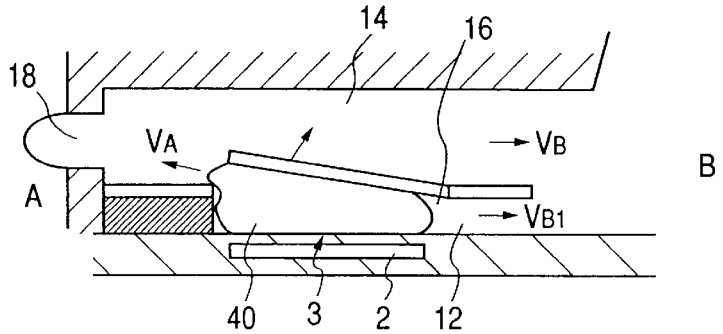
Figure 9C:
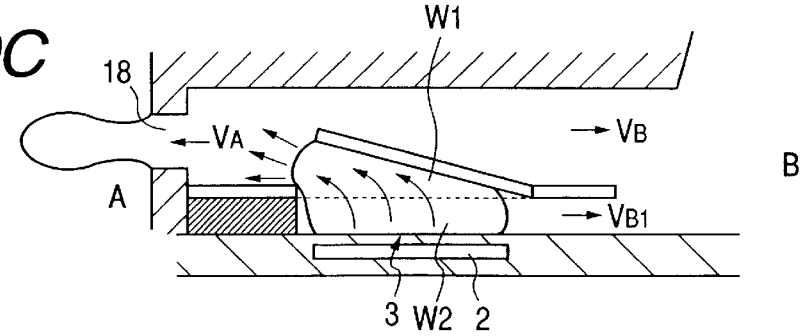

FIGS. 9A to 9D are cross-sectional views which illustrate a liquid discharge head, taken in the liquid flow path direction thereof. FIG. 10 is a partially broken perspective view which shows the liquid discharge head. In FIGS. 9A to 9D, the liquid discharge head is provided with the heat generating member 2 (a heat generating resistive member in the form of 40 $\mu$m×105 $\mu$m for the present example) arranged on the elemental substrate 1, which activates thermal energy on liquid as the element that generates energy to be utilized for discharging liquid. Each of the liquid flow paths 10 is arranged on the elemental substrate corresponding to each of the heat generating members. Each of the liquid flow paths 10 is communicated with each of the discharge ports 18, and at the same time, communicated with the common liquid chamber 13 that supplies liquid to a plurality of liquid flow paths 10. Each of the liquid flow paths receives liquid from this common liquid chamber 13 in an amount that matches the liquid having been discharged from the discharge port.

On the elemental substrate where the liquid flow path 10 is arranged, the plate type movable member 31 formed by elastic metal material or the like, which is provided with a plane portion, is arranged in a cantilever fashion so as to face the heat generating member 2 described earlier. One end of the movable member is fixed on the stand (supporting member) 34 or the like formed by patterning a photosensitive resign or the like on the walls of the liquid flow path 10 or on the elemental substrate. In this manner, the movable member is supported, and at the same time, the fulcrum (fulcrum portion) 33 is structured.

The movable member 31 is arranged in a position to face the heat generating member 2 with a gap of approximately 15 $\mu$m with the heat generating member 2 so as to cover it and provide the fulcrum (fulcrum portion: fixed end) 33 on the upstream side of a large flow running by the operation of liquid discharge from the common liquid chamber 13 to the discharge port 18 side through the movable member 31, and the free end (free end portion) 32 on the downstream side with respect to this fulcrum 33. Between the heat generating member and the movable member becomes each of the bubble generating areas. Here, the kinds and shapes of the movable member, as well as the arrangement positions thereof are not necessarily confined to those described above. It should be good enough if only the shape and arrangement position are such as to be able to control the development of each bubble and the propagation of pressure as described later. In this respect, for the convenience of describing the flow of liquid, which will be taken up later, the portion that communicates with the discharge port 18 direction is defined as a first liquid flow path 14, and the portion having the bubble generating area 11 and the liquid supply path 12 is defined as a second liquid flow path 16, that is, the each of the liquid flow paths 10 described above is divided into these two portions with the movable member 31 as the boundary thereof.

Now, when the heat generating member 2 is energized, heat acts upon liquid in the bubble generating area 11 between the movable member 31 and the heat generating member 2. Then, bubbles are created by means of the film boiling phenomenon disclosed in the specification of U.S. Pat. No. 4,723,129. The pressure exerted by the creation of bubble, and the bubble thus created are allowed to act upon the movable member priorly, and as shown in FIGS. 9B and 9C or FIG. 10, the movable member 31 is displaced to open it largely to the discharge port side centering on the fulcrum 33. By the displacement or by the displaced condition of the movable member 31, the propagation of the pressure exerted by the creation of bubble and the development of bubble itself are guided to the discharge port side.

Here, the description will be made of one of the discharge principles fundamentally applicable to the present invention. One of the most important principles for the present invention is that the movable member arranged to face the bubble is displaced from the steady-state first position to the second position which is after displacement due to the bubbling pressure or the bubbling itself, and that the bubbling pressure or the bubbling itself is guided by the displacement of the movable member 31 to the downstream side where the discharge port 18 is arranged.

Now, with comparison of FIG. 11 which shows the conventional liquid flow path structure schematically, where no movable members are arranged, and FIG. 12 which shows the present example, this principle will be described further in detail. Here, the pressure propagating direction in the discharge port direction is designated by a reference mark VA, and the pressure propagating direction toward the upstream side is designated by a reference mark VB.

Figure 11:
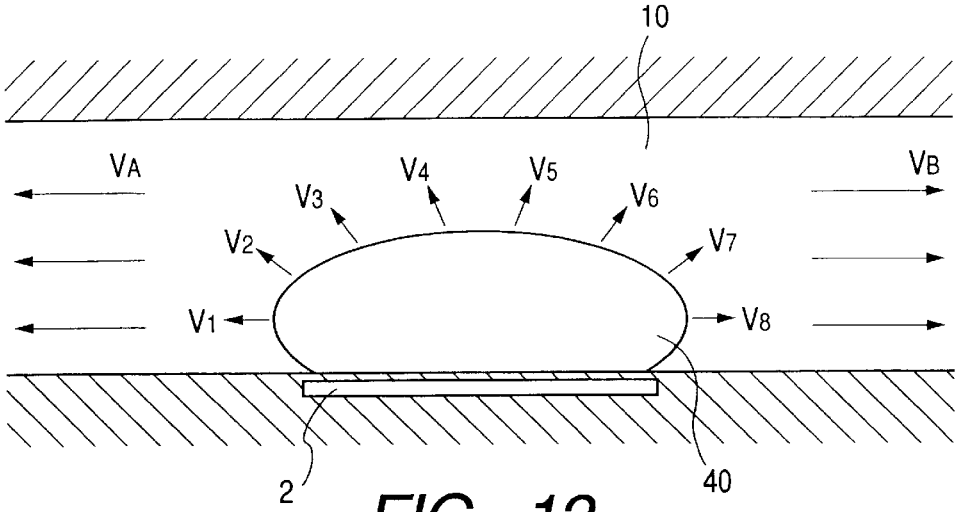
FIG. 11 is a view which schematically shows the pressure propagation from a bubble to the conventional liquid discharge head.

In accordance with the conventional head as shown in FIG. 11, it is not arranged to provide any structure to regulate the propagating direction of the pressure exerted by the creation of the bubble 40. As a result, the pressure propagating direction of the bubble 40 is orientated variously in the vertical direction of the bubble surface as at V1 to V8. Of those directions, the ones having components in the VA direction of the pressure propagation, which may exert influence mostly on the liquid discharge in particular, are the directional components at V1 to V4, that is, on the portions nearer to the discharge port positioned almost in a half of the bubble which is the important part to directly related to the liquid discharge efficiency, liquid discharge power, discharge speed, and others. Further, the V1 functions in good efficiency because it is closed in the discharge direction VA, and on the contrary, the V4 has a comparatively small directional component toward the VA.

Figure 12:
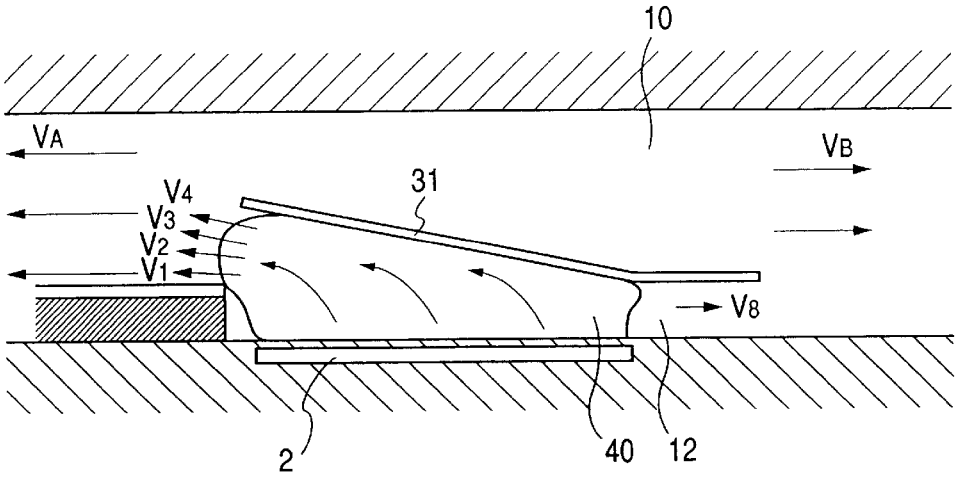
FIG. 12 is a view which schematically shows the pressure propagation from a bubble to the liquid discharge head.

In contrast, the case represented in FIG. 12 is such that the movable member 31 guides the various pressure propagating directions of bubble at V1 to V4 as shown in FIG. 11 to the downstream side (discharge port side) and then, convert them into the pressure propagation direction of VA. In this way, the pressure exerted by the bubble 40 is allowed to contribute directly to the discharge efficiently. Thus, the development direction of the bubble itself is also guided in the downstream direction as in the pressure propagating direction V1 to V4, and the bubble is developed larger in the downstream than the upstream. In this way, with the movable member, the development direction of the bubble is controlled, and the pressure propagating direction of the bubble is controlled, hence making it possible to make the basic enhancement of the discharge efficiency, discharge power, and also, the discharge speed among some others.

Now, reverting to FIGS. 9A to 9D, detailed description will be made of the discharge operation of the liquid discharge head described above. FIG. 9A shows the state before energy, such as electric energy, is applied to the heat generating member 2, which is the state before the heat generating member has generated heat. What is most important here is that the movable member 31 is positioned to face at least the downstream side portion of the bubble which has been created by the heat generated by the heat generating member. In other words, the movable member 31 is arranged at least up to the position on the downstream side of the area center 3 of the heat generating member on the structural arrangement of the liquid flow path (that is, the downstream of the line which is orthogonal to the longitudinal direction of the flow path, running through the area center 3 of the heat generating member).

FIG. 9B shows the state where electric energy or the like is applied to the heat generating member 2 and the heat generating member 2 has generated heat, and that a part of the liquid filled in the bubble generating area 11 is heated by the application of heat thus generated to create the bubble following the film boiling. At this juncture, the movable member 31 is displaced from the first position to the second position by the pressure exerted by the creation of the bubble 40 so as to lead the propagation of the pressure of the bubble 40 in the discharge port direction. Here, as described earlier, it is important to arrange the free end 32 of the movable member 31 on the downstream side (discharge port side), and to arrange the fulcrum 33 on the upstream side (common liquid chamber side) so that at least a part of the movable member is allowed to face the downstream side of the heat generating member, that is, to face the downstream portion of the bubble.

FIG. 9C shows the state where the bubble 40 is further developed. Here, the movable member 31 is further displaced by the pressure exerted by the creation of the bubble 40. At the same time that the bubble thus created is developed larger on the downstream side than the upstream side, it is developed greatly beyond the first position (the position indicated by the dotted line) of the movable member. Here, with the gradual displacement of the movable member 31 along with such development of the bubble 40, it becomes possible to lead the development direction of the bubble uniformly to the free end side, that is, the direction in which the propagation of pressure exerted by the bubble 40 or the voluminal shift thereof is made easily shiftable. Here, conceivably, this event contribute to the enhancement of the discharge efficiency. Then, there is almost no hindrance presented by the movable member as to the propagation when the bubble and the bubbling pressure are guided in the discharge port direction, hence making it possible to control the pressure propagating direction and the development direction of the bubble efficiently in accordance with the intensity of the pressure to be propagated.

Figure 9D:
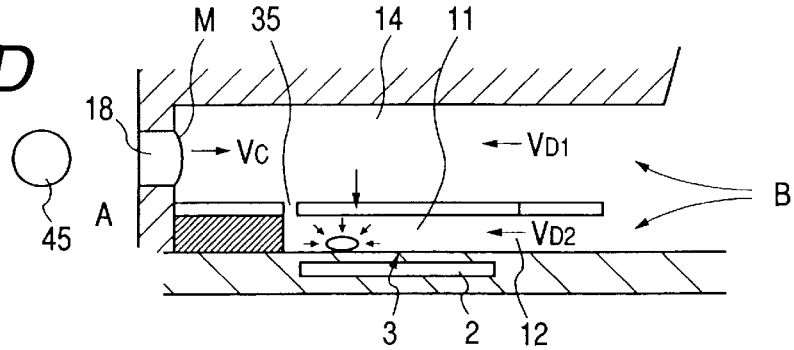
Figure 10:
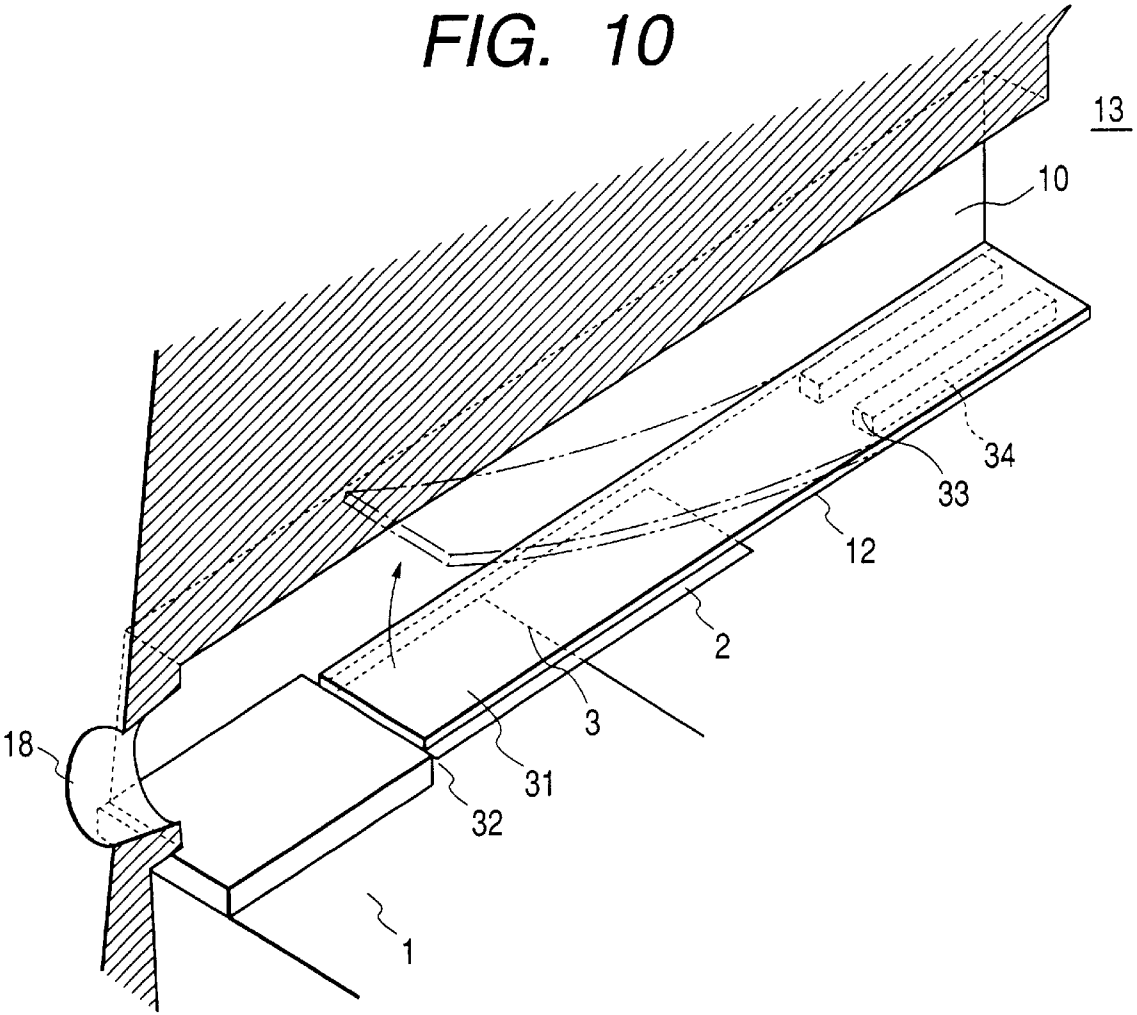
FIG. 10 is a broken perspective view which shows a liquid discharge head.

FIG. 9D shows the state where the bubble 40 is contracted due to the reduction of the inner pressure of the bubble after the film boiling described earlier, and it is defamed. The movable member 31 which has been displaced to the second position is restored to the initial position (the first position) shown in FIG. 9A due to the negative pressure exerted by the contraction of the bubble and the restoring force of the resiliency of the movable member itself. Also, at the time of bubble disappearance, liquid flows in from the upstream side (B), that is, the flows VD1 and VD2 from the common liquid chamber side, and also, from the discharge port side as the flow VC in order to compensate for the contracted volume on the bubble generating area 11, as well as the volume of the liquid that has been discharged.

So far, the operation of the movable member along with the creation of the bubble, and the discharge operation of liquid have been described. Now, hereunder, the detailed description will be made of the liquid refilling for the liquid discharge head to the present example is applicable. Subsequent to the state shown in FIG. 9C, the bubble 40 enters the bubble disappearance process through the condition that the volume of the bubble is made maximum. Then, the liquid that compensate for the volume reduced by bubble disappearance flows into the bubble generating area from the discharge port 18 side on the first liquid flow path 14, and also, from the common liquid chamber 13 side on the second liquid flow path 16. With the conventional liquid flow path structure where no movable member 31 is provided, the amount of liquid that flows into the bubble disappearance position from the discharge port side, and the amount of liquid that flows into it from the common liquid chamber side are dependent on the intensity of flow resistance on the portion nearer to the discharge port than the bubble generating area and on the portion nearer to the common liquid chamber (that is, based on the flow path resistance and the inertia of liquid).

Therefore, if the flow resistance on the side close to the discharge port, a great amount of liquid flows into the bubble disappearance position from the discharge port side to cause the greater amount of the meniscus retraction. Particularly, if it is attempted to make the discharge efficiency higher by reducing the flow resistance on the side close to the discharge port, the retraction of the meniscus M becomes larger at the time of bubble disappearance. As a result, the refilling time becomes longer to impede the attempted higher printing eventually.

In contrast, with the provision of the movable member 31, the retraction of the meniscus comes to a stop when the movable member is restored to the original position at the time of bubble disappearance, provided that the volume W on the upper side is given as W1 with the first position of the movable member 31 as the boundary, and the bubble generating area 11 side as W2. Then, the liquid supply for the volume of the remaining W2 is mainly made by the flow VD2 on the second flow path 16. In this way, it becomes possible to suppress the retractable amount of meniscus to the amount almost a half of the W1 which is smaller than almost a half of the volume of the bubble W, that is, the conventional retractable amount of the meniscus. Further, the liquid supply for the voluminal portion of the W2 can be effectuated mainly from the upstream side (VD2) of the second liquid flow path compulsorily along the face of the movable member 31 on the heat generating member side by the utilization of the pressure at the time of bubble disappearance, hence making it possible to implement a faster refilling.

Here, what is characteristic is that whereas the degradation of image quality is encountered due to the greater vibrations of meniscus when the refilling is effectuated by the application of pressure at the time of bubble disappearance by use of the conventional head, it becomes possible to make the vibrations of the meniscus extremely small, because the distribution of liquid is suppressed by the presence of the movable member on the discharge port side in the area of the first flow path 14, and on the discharge port side in the bubble generating area 11 when the high-speed refilling is effectuated by use of the structure of the present example.

As described above, the structure which is applicable to the present example makes it possible to implement the enhancement of image quality and high-speed recording when used for the fields that require the stable discharges or the repeated discharges at high speeds, and also, for use of recording, because the high-speed refilling is now attained by the compulsory refilling to the bubble generating area through the liquid supply path 12 on the second liquid flow path 16, as well as by the suppression of the retraction and vibrations of the meniscus.

The structure applicable to the present example is further combined with the effective function as given below. In other words, it is made possible to suppress the propagation of the pressure exerted by bubbling (the back waves) to the upstream side. Most of the pressure exerted by bubbling on the heat generating member 2 on the common liquid chamber side 33 used to become the force that pushes back liquid toward the upstream side (that is, the back waves). Such back waves incur the pressure on the upstream side, the liquid shift due to this pressure, and the inertia following such liquid shift, which are all factors to slow down the refilling of liquid into the liquid flow path, and also, impede the higher driving. With the structure applicable to the present example, it is attempted to enhance the refilling supply capability still more by use of the movable member 31 which suppresses at first such action that may affect the condition on the upstream side.

Now, the characteristic structure and effect will be described further as given below.

The second liquid flow path 16 is provided with the liquid supply path 12 on the upstream side of the heat generating member 2, having the inner walls which are connected with the heat generating member 2 almost flatly (here, the surface of the heat generating member does not fall largely). In this case, the liquid supply to the surface of the bubble generating area 11 and the heat generating member 2 is made as at the VD2 along the face of the movable member 31 on the side close to the bubble generating area 11. Therefore, any stagnation of liquid is suppressed on the surface of the heat generating member 2 to make it easier to remove the gaseous educt dissolved into liquid, as well as the so-called residual bubbles which have not been deformed completely, and also, to prevent the heat accumulation from becoming too high on the liquid. As a result, the stabilized bubbling can be repeated at high speeds. Here, the structure has been described to be provided with the liquid supply path 12 which has the substantially flat inner walls, but the present invention is not necessarily limited to such structure. It should be good enough if only the liquid supply path has the smooth inner walls which can be connected with the surface of the heat generating member smoothly, and which is configured so that liquid stagnation does not occur on the heat generating member or any large disturbance does not take place when liquid is supplied.

Also, the liquid supply to the bubble generating area is made at VD1 through the side portion (slit 35) of the movable member. However, as shown in FIGS. 9A to 9D, the large movable member is adopted to cover the bubble generating area entirely (to cover the surface of the heat generating member) so that the bubbling pressure is guided to the discharge port more effectively. Consequently, if the mode is such that the flow resistance becomes greater in the region close to the bubble generating area 11 and the discharge port of the first liquid flow path 14, the liquid flow at the VD1 described earlier, which is directed to the bubble generating area 11, is impeded by the restoration of the movable member to the first position. With the head structure described above, however, the flow of liquid supply to the bubble generating area is at the VD2 where the liquid supply capability becomes extremely high. Consequently, there is no possibility that the liquid supply capability is lowered even if the structure is arranged so as to enhance the discharge efficiency by the movable member 31 that covers the bubble generating area 11.

Figure 13:
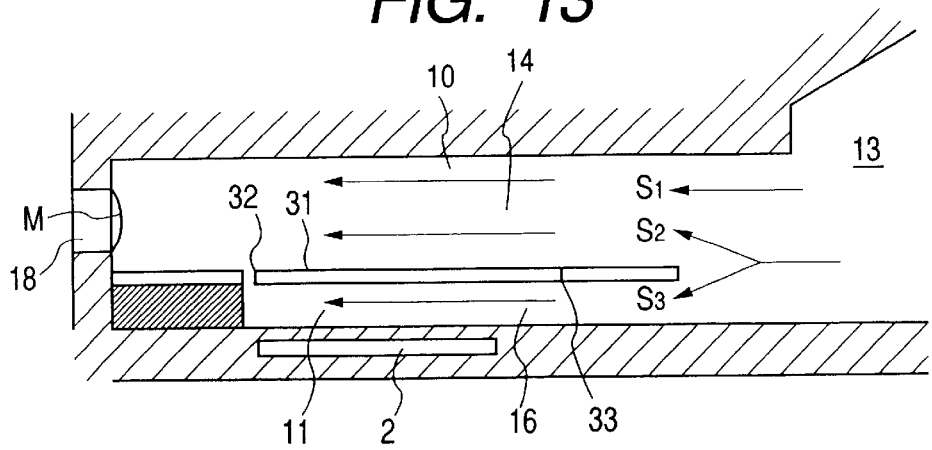
FIG. 13 is a view which schematically illustrates the flow of liquid.

Now, the positions of the free end 32 and the fulcrum 33 of the movable member 31 are such that the free end is relatively on the downstream side of the fulcrum as shown in FIG. 13, for example. With the structure thus arranged, it is possible to materialize the functions and effects efficiently to guide the propagating direction of the pressure exerted by the bubble and the developing direction of the bubble to the discharge port side at the time of bubbling. Also, this positional relation not only present the functions and effects of discharges, but also, makes it possible to reduce the flow resistance to the liquid that runs in the liquid flow path 10, hence producing the effect that refilling is effectuated at higher speeds when the liquid is supplied. This is because, as shown in FIG. 13, the free end and the fulcrum 33 are arranged not to be against the flows S1, S2, and S3 in the liquid flow path 10 (including the first flow path 14 and the second flow path 16) when the meniscus M, which has been retracted by discharge, is restored to the discharge port 18 by means of the capillary force or when the liquid is supplied at the time of bubble disappearance.

To supplement, the free end 32 of the movable member 31 of the structure arranged for the present example shown in FIGS. 9A to 9D is extended over the heat generating member 2 so that it faces the position on the downstream side of the area center 3 which divides the heat generating member 2 into two, the upstream side area and the downstream side area (that is, the line running through the area center (the central portion) of the heat generating member, which is orthogonal to the longitudinal direction of the liquid flow path). In this way, the pressure exerted on the downstream side of the area central 3 of the heat generating member, or the bubble, is received by the movable member 31, and then, this pressure and bubble are guided to the discharge port side so as to fundamentally enhance the discharge efficiency and discharge power. Besides this fundamental enhancement, the upstream side of the bubble is utilized to obtain many other effects. Also, the instantaneous mechanical displacement of the free end of the movable member 31, which is adopted for the structure of the present example, is considered to contribute to the effective liquid discharges.

Figure 14:
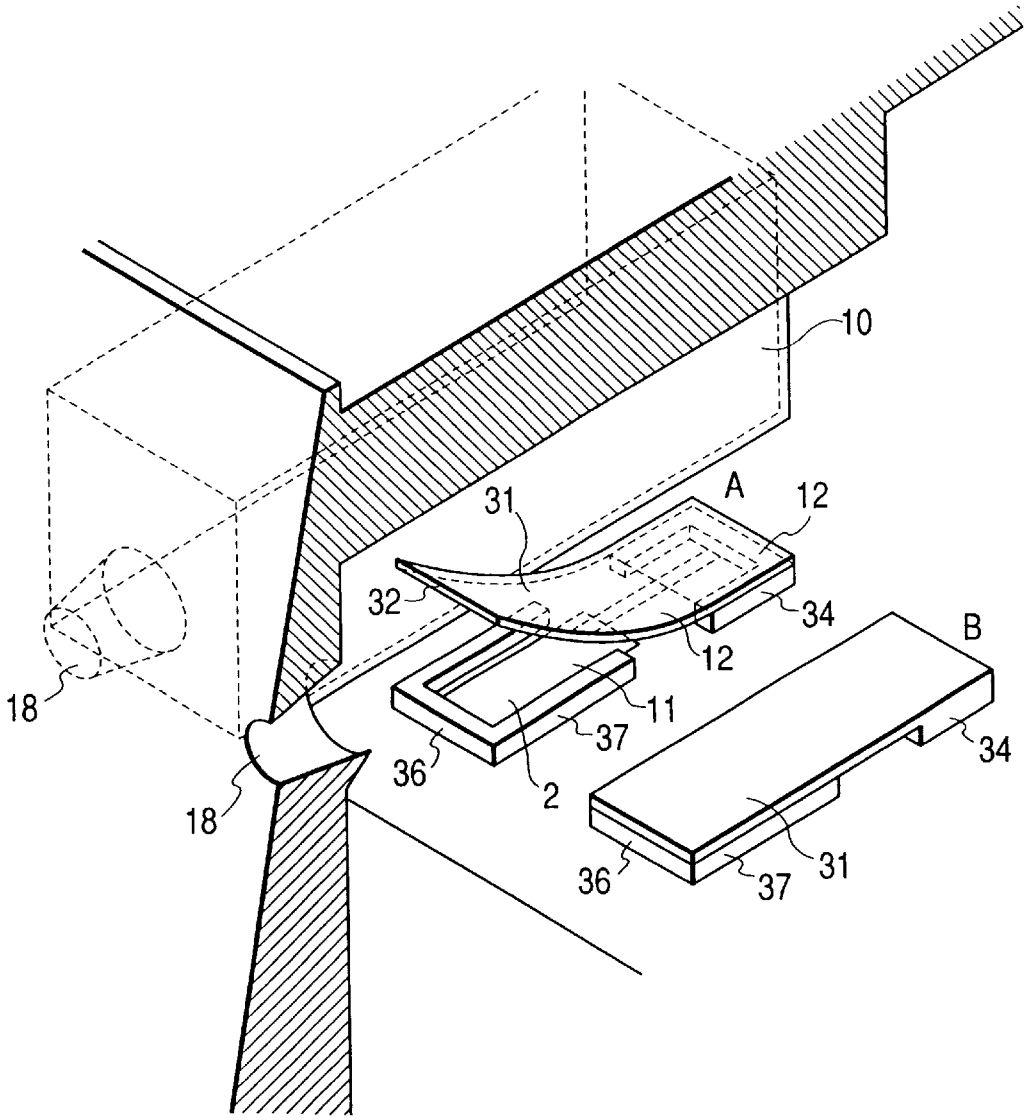
FIG. 14 is a partially broken perspective view which shows the liquid discharge head.

FIG. 14 is a partially exploded perspective view which shows another example of the liquid discharge head. In FIG. 14, the reference mark A designates the state that the movable member is displaced (bubble is not shown), and B, the state that the movable member is in the initial position (the first position). In this state B, it is assumed that the bubble generating area 11 is essentially closed to the discharge port 18. Although not shown here, there is the flow path wall between the A and B to separate one flow path from another. In FIG. 14, the movable member 31 is provided with two points on the side portions of the stand 34, and between these points, the liquid supply path 12 is arranged. In this way, along the face of the movable member on the heat generating member side, it is possible to effectuate the liquid supply from the liquid supply path which is also provided with the substantially flat or smooth face connected with the surface of the heat generating member.

Here, in the initial position (the first position) of the movable member 31, the movable member 31 approaches the downstream wall 36 and side wall 37 of the heat generating member arranged on the downstream side and in the side direction of the heat generating member 2 or the movable member is in close contact with them so that the bubble generating area 11 is essentially closed from the discharge port 18 side. Therefore, the pressure at the time of bubbling, particularly the pressure on the downstream side of the bubble acts upon the free end side of the movable member intensively without allowing it to escape. Also, at the time of bubble disappearance, the movable member 31 returns to the first position to essentially close the discharge port side of the bubble generating area 31. As a result, it becomes possible to obtain the various effects described in conjunction with the previous example, such as the suppression of the meniscus retraction, when liquid is supplied to the heat generating member at the time of bubble disappearance. Also, for the refilling operation, the same functions and effects can be obtained as in the previous example.

Also, in accordance with the present example, the stand 34 that supports and fixes the movable member 31 is arranged on the upstream away from the heat generating member 2 as shown in FIG. 10 or FIG. 14, and at the same time, the width of the stand 34 is made smaller than that of the liquid flow path 10. In this manner, liquid is supplied to the liquid supply path 12 as described earlier. Also, the shape of the stand 34 is not necessarily confined to this one. It should be good enough if only the refilling is performed smoothly. Here, for the present example, the gap between the movable member 31 and the heat generating member 2 is set at approximately 15 $\mu$m. However, such gap may be within a range in which the pressure exerted by the creation of bubble can be transferred to the movable member sufficiently.

Figure 15:
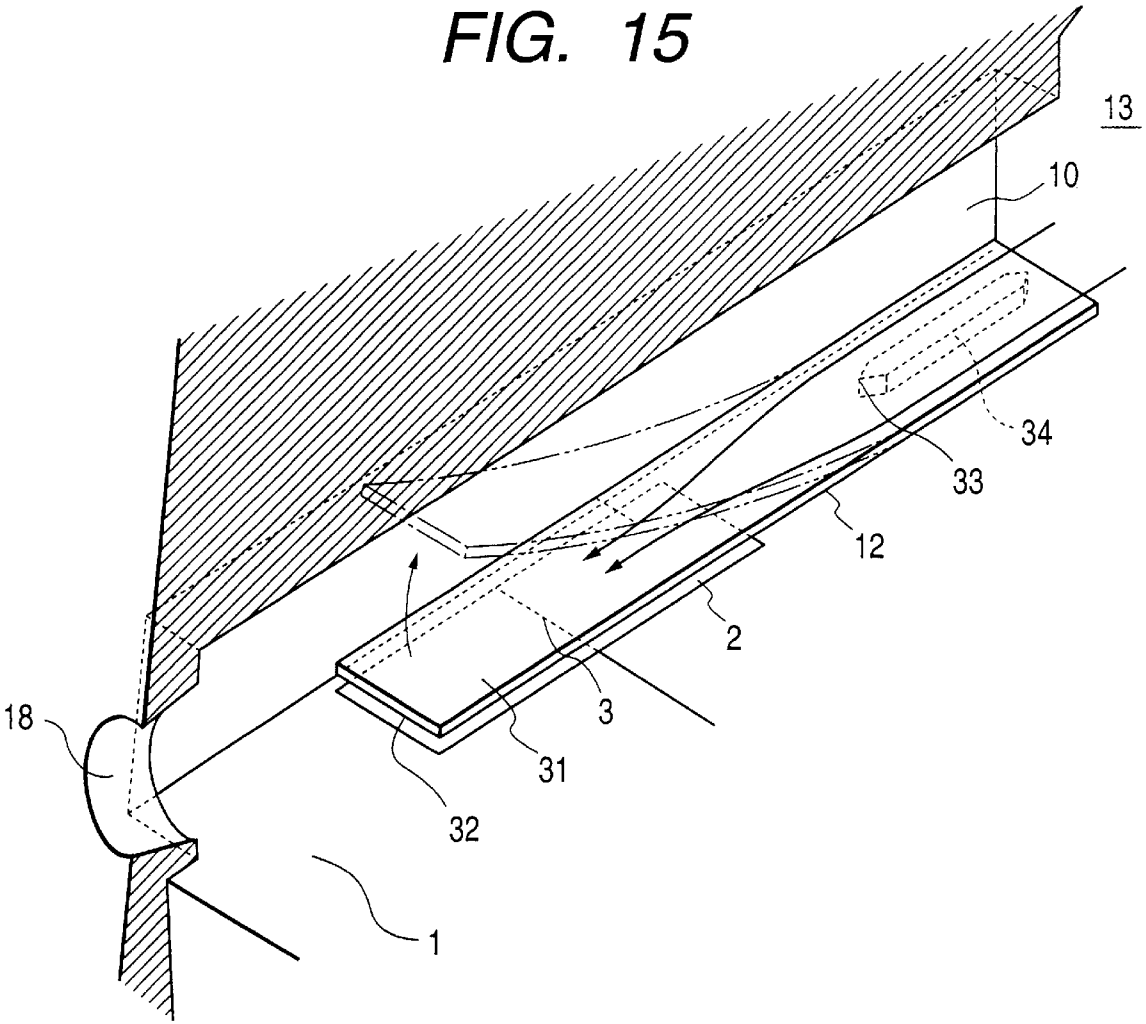
FIG. 15 is a partially broken perspective view which shows the liquid discharge head.

FIG. 15 is a partially broken perspective view which shows another example of the liquid discharge head. This example illustrates one of the fundamental concepts of the present example. FIG. 15 shows the bubble generating area in one of the liquid flow paths, and also, the positional relationship between the bubble created in that area, and the movable member. At the same time, FIG. 15 represents the liquid discharge method and refilling method easily in accordance with the present example. In most of the previous examples, it is attained that the bubbling pressure is concentrated on the free end of the movable member to shift the movable member abruptly, and at the same time, to concentrate the bubble shifting on the discharge port side. In contrast, in accordance with the present example, the downstream side portion of the bubble, which is the discharge port side of the bubble to act directly upon the liquid discharge, is regulated on the free end side of the movable member, while giving freedom to the bubble to be created.

As compared with the example shown in FIG. 10, the one shown in FIG. 15 is not provided with the convex portion arranged on the elemental substrate 1 represented in FIG. 10 as the barrier positioned on the downstream end of the bubble generating area. In other words, the free end area and both side end areas of the movable member are open, and not essentially closed to the discharge port area. In accordance with the present example, since the bubble development is possible on the leading end portion on the downstream side of the downstream side portion of the bubble that directly acts upon the liquid discharge, the pressure component thereof is effectively utilized for discharge. In addition, the free end portion of the movable member functions to add at least the pressure (components V2, V3, and V4 in FIG. 11) which is directed toward above the downstream side portion to the bubble development on the leading end portion on the downstream side, hence making it possible to enhance the discharge efficiency as in the examples described above. As compared with the previous examples, the present one is superior in the response capability to the driving of the heat generating member. Also, the present example is simpler in its structure to present an advantage in terms of manufacture.

In accordance with the present example, the fulcrum of the movable member 31 is fixed on one stand 34 in a width smaller than that of the face of the movable member. Therefore, the liquid supply is made to the bubble generating area 11 through both sides of this stand at the time of bubble disappearance (as indicated by arrows in FIG. 15). This stand may be structured in any shape if only it can secure the intended supply capability. For the present example, the liquid, which flows from above into the bubble generating area at the time of bubble disappearance, is controlled by the presence of the movable member when refilling is made for the liquid supply. Therefore, this structure is superior to the conventional one where the bubble generating area is formed only by the heat generating member. There is of course no possibility that the retractable amount of the meniscus is reduced by the formation of this structure.

As the variational example of the present example, it is possible to preferably cite the one in which only both side ends (only one of them will do) of the free end of the movable member are arranged to be in the essentially closed condition with respect to the bubble generating area 11. With the structure thus arranged, the discharge efficiency is enhanced still more, because the pressure directed toward the sides of the movable member can also be utilized after transforming it into the development force of the end portion of the bubble on the discharge port side as described earlier.

So far, the description has been made of the discharge principles which are applicable to the present example in accordance with one flow path of the liquid discharge head where the liquid used for bubbling by the application of heat, and the liquid used for discharge are the same. Now, the description will be made of the liquid discharge head having two flow paths separated for the liquid used for bubbling by the application of head (bubbling liquid) and the liquid used for discharge (discharge liquid), which adopts the same discharge principles for the main liquid.

Figure 16:
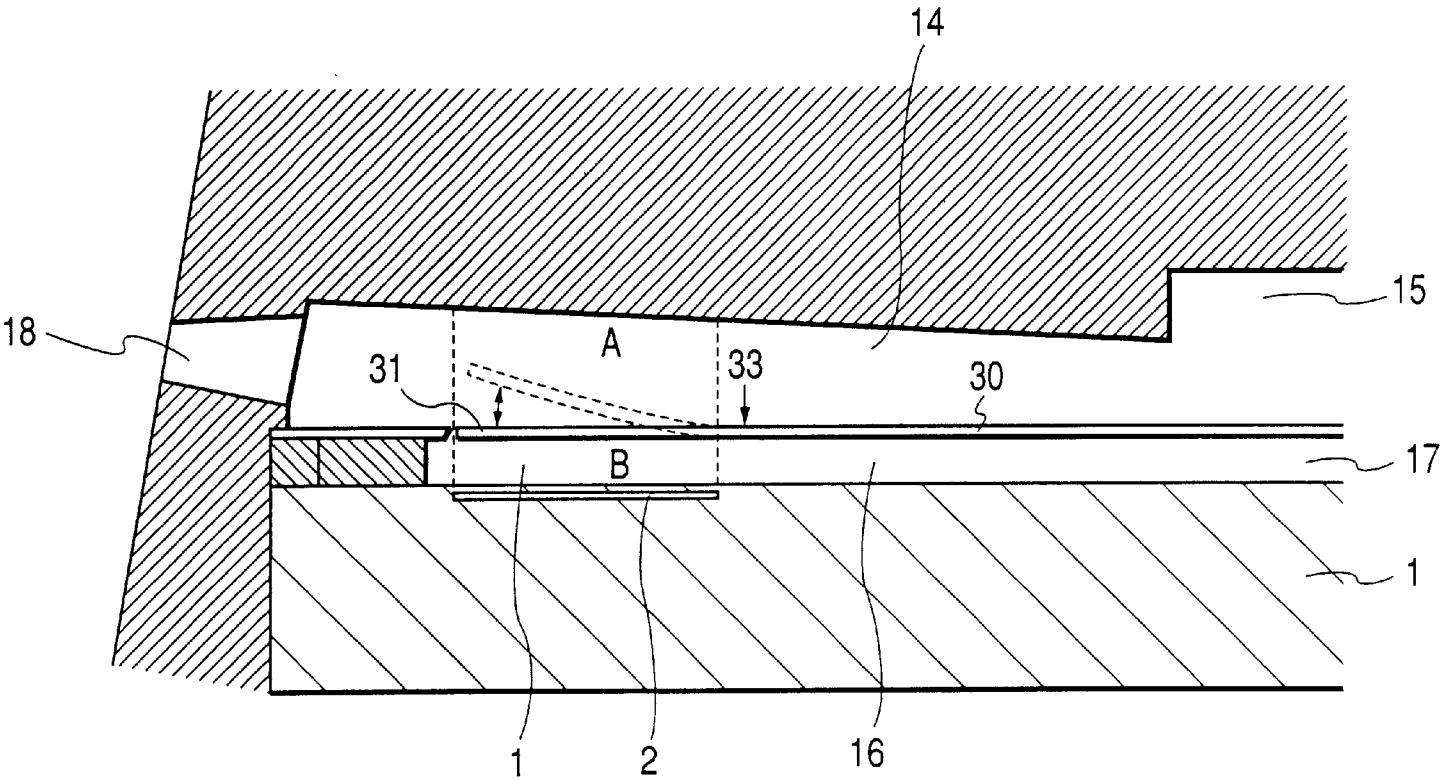
FIG. 16 is a cross-sectional view which schematically shows the liquid discharge head.
Figure 17:
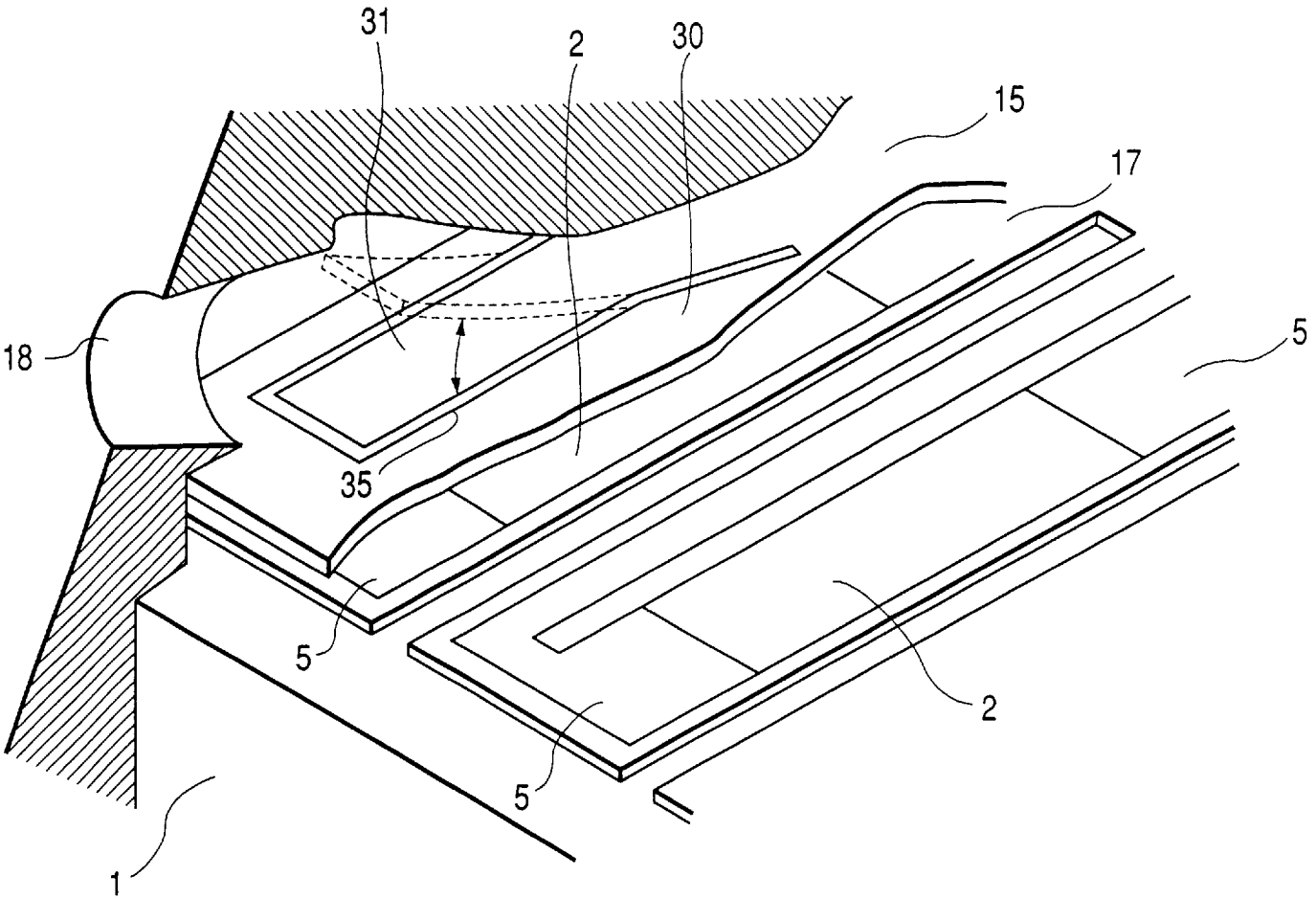
FIG. 17 is a partially broken perspective view which shows the liquid discharge head.

FIG. 16 is a cross-sectional view schematically showing the two-flow path liquid discharge head, taken in the flow path direction. FIG. 17 is a partially broken perspective view which shows this liquid discharge head. For the two-flow path liquid discharge head, the second liquid flow path 16 for use of bubbling is arranged on the elemental substrate 1 where the heat generating member 2 is arranged to provide thermal energy to create bubble in liquid. On this flow path, the first flow path 14, is arranged to be directly communicated with the discharge port 18. The upstream side of the first liquid flow path is communicated with the first common liquid chamber 15 to supply discharge liquid to a plurality of the first liquid flow paths. The upstream side of the second liquid flow path is communicated with the second common liquid chamber 17 to supply bubbling liquid to a plurality of the second liquid flow paths.

Between each of the first and second liquid flow paths, the separation wall 30 formed by resilient material such as metal to separate the first liquid flow path and the second liquid flow path. Here, when using the liquid for which the bubbling liquid and the discharge liquid should not be mixed as much as possible, it is preferable to separate the first liquid flow path 14 and the second liquid flow path 16 by use of this separation wall as completely as possible. If the bubbling liquid and the discharge liquid should be mixed to a certain extent, but still present no problem, it may be unnecessary to provide the separation wall with the function that implements the perfect separation.

The portion of the separation wall, which is positioned in the upward projection space in the surface direction of the heat generating member (hereinafter referred to as a discharge pressure generating area; the A area and B area of the bubble generating area 11 in FIG. 16), is arranged to serve as the movable member 31 in a cantilever fashion having the free end on the discharge port side (downstream side of the liquid flow) by means of the slit 35, and the fulcrum 33 positioned on each of the common liquid chambers (15 and 17) side. This movable member 31 is arranged to face the surface of the bubble generating area 11 (B). Then, by bubbling of the bubbling liquid, the movable member operates to open toward the discharge port side of the first liquid flow path side (in the direction indicated by arrows in FIG. 16).

In FIG. 17, too, the separation wall 30 is arranged through the same that forms the second liquid flow path on the elemental substrate 1 having the heat generating resistive portion which serves as the heat generating member 2, and the wiring electrodes 5 which apply electric signals to the heat generating resistive portion on it. The arrangement of the fulcrum 33 and the free end 32 of the movable member 31, and the arrangement relationship with the heat generating member 2 are the same as those described above for the one-flow path head. Also, the structural relationship between the liquid flow path 12 and the heat generating member 2 is described for the one-flow path head. The structural arrangement between the second liquid flow path 16 and the heat generating member 2 is the same for the two-flow path head.

Now, in conjunction with FIGS. 18A and 18B, the description will be made of the operation of the two-flow path liquid discharge head. To drive the head, the same water ink is used as the discharge liquid to be supplied to the first liquid flow path 14 and as the bubbling liquid to be supplied to the second liquid flow path 16. The heat generated by the heat generating member 2 acts upon the bubbling liquid on the bubble generating area of the second liquid flow path. Then, the bubble 40 is created on the basis of the film boiling phenomenon disclosed in the specification of the U.S. Pat. No. 4,723,129 in the same manner as described in conjunction with the previous examples.

For the two-flow path head, the bubbling pressure is not allowed to escape form the three directions with the exception of the upstream side of the bubble generating area. Therefore, the pressure following this bubbling is propagated intensively on the movable member 6 side arranged for the discharge pressure generating portion. Along with the development of the bubble, the movable member 31 is displaced to the first liquid flow path side from the state shown in FIG. 18A to the state shown in FIG. 18B. With this operation of the movable member, the first liquid flow path 14 and the second liquid flow path 16 are largely communicated to enable the pressure based on the creation of bubble to be transferred mainly in the direction toward the discharge port side of the first liquid flow path (direction A). With the portion of this pressure combined with the mechanical displacement of the movable member, liquid is discharged from the discharge port.

Figure 18A:
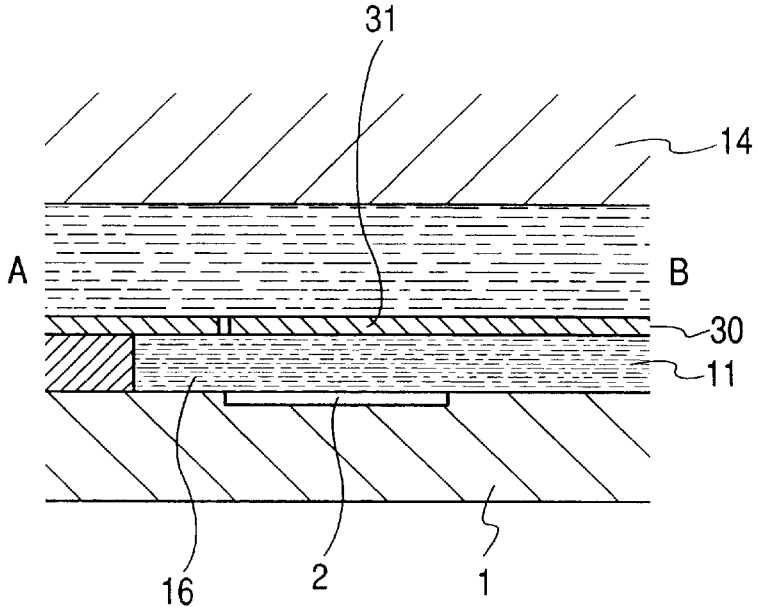
FIGS. 18A and 18B are views which illustrate the operation of movable member.
Figure 18B:
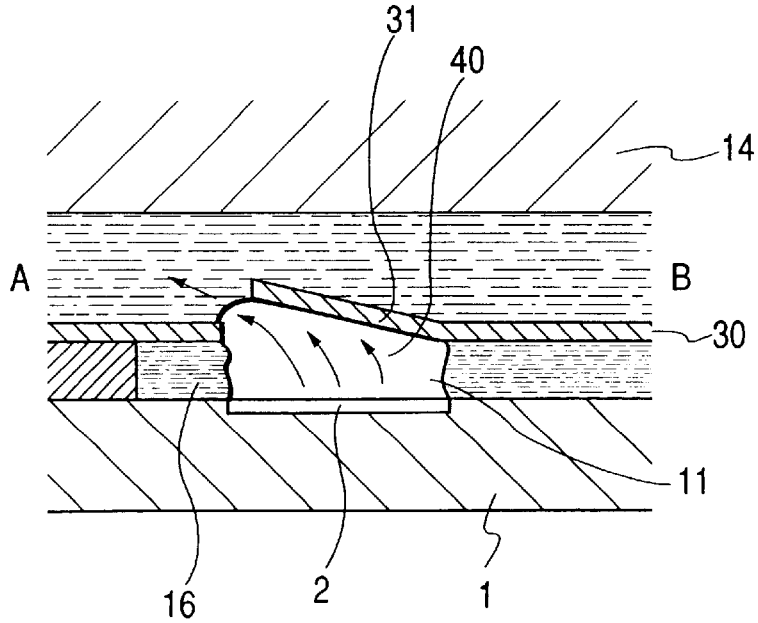

Now, along with the contraction of the bubble, the movable member 31 returns to the position shown in FIG. 18A, and at the same time, an amount of discharge liquid that matches the amount of the discharge liquid that has been discharged is supplied from the upstream side of the first liquid flow path 14. For the two-flow path structure, the supply of the discharge liquid is in the direction in which the movable member is closed as in the previous examples. Therefore, there is no possibility that the movable member impedes the refilling of the discharge liquid.

The two-flow path head is the same as the one-flow path head with respect to the propagation of bubbling pressure following the displacement of the movable member, the developing direction of the bubble, the prevention of the back waves, and other functions and effects of the principal part thereof. However, with the two-flow path structure, it becomes possible to use the discharge liquid and the bubbling liquid as different liquids, and discharge the discharge liquid by the application of the pressure exerted by bubbling of the bubbling liquid. As a result, it becomes possible to discharge in good condition even a highly viscous liquid, such as polyethylene glycol, which presents insufficient discharge power due to insufficient bubbling by the application of heat conventionally. Here, with the structure thus arranged, the liquid of the kind is supplied to the first liquid flow path, while a liquid which performs good bubbling (such as a mixed liquid of approximately 1 to 2 cp of ethanol:water=4:6) or a liquid having a lower boiling point is supplied to the second liquid flow path.

Also, it becomes possible to select as the bubbling liquid a liquid that does not produce deposition such as burnt substance on the surface of the heat generating member when heat is applied, hence making it possible to stabilize bubbling for the performance of discharges in good condition. Further, with the head of the two-flow path structure, the same effect as described for the one-flow path head is obtainable, thus making it possible to discharge the highly viscous liquid or the like with higher discharge efficiency and higher discharge power.

Also, when the liquid whose property is weaker against heat is used, the kind of liquid is supplied to the first liquid flow path as the discharge liquid, while the liquid whose property is hardly changeable by the application of heat, but presents good bubbling is supplied to the second liquid flow path. Then, the thermally weaker liquid is used without damaging it thermally, while it is discharged with higher discharge efficiency and higher discharge power.

[The Evoluted Types]

So far, the description has been made of the discharge principles applicable to the present invention. Now, hereunder, the evoluted types, which are applicable to those examples, will be described.

(Movable Member and Separation Wall)

Figure 19A:
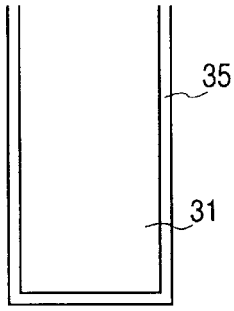
FIGS. 19A, 19B and 19C are views which illustrate the other configurations of the movable member.
Figure 19B:
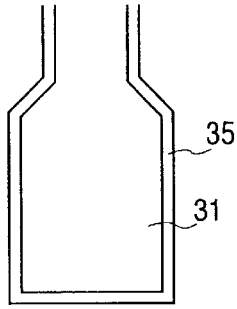
Figure 19C:
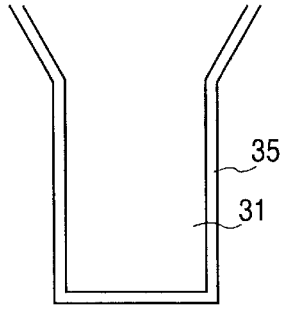

FIGS. 19A to 19C are plan views which illustrate the other configurations of the movable member 31, respectively. A reference numeral 35 designates the slit provided for the separation wall. Then, by means of this slit, the movable member 31 is formed. FIG. 19A shows a rectangular one; FIG. 19B, the one having the narrower fulcrum side which makes the operation of the movable member easier; and FIG. 19C, the one having the wider fulcrum side to enhance the robustness of the movable member. It should be good enough if only the movable member is configured to be able to operate easily with an excellent durability.

In accordance with the previous examples, the plate type movable member 31 and the separation wall 30 provided with the movable member are formed by nickel of 5 μm thick. However, the material is not necessarily limited to it. As the one that forms the movable member and the separation wall, it should be good enough if only the material has the solvent resistance to bubbling liquid and discharge liquid, as well as the resiliency with which it can operate as a movable member in good condition, and also, if the material enables the fine slit to be formed on it.

As the material for the movable member, it is desirable to use the metal which has a high durability, such as silver, nickel, gold, iron, titanium, aluminum, platinum, tantalum, stainless steel, phosphor bronze, or the alloy thereof; resins of nitrile group, such as acrylonitrile, butadiene, styrene; resins of amide group, such as polyamide; resins of carboxyl group, such as polycarbonate; resins of aldehyde group, such as polyacetal; resins of sulfone group, such as polysulfone, or liquid crystal polymer or other resin and the compound thereof; the metal which has high resistance to ink, such as gold, tungsten, tantalum, nickel, stainless steel, titanium, or the alloy thereof or any one of them having it coated on the surface to obtain resistance to ink; or resins of amide group, such as polyamide; resins of aldehyde group, such as polyacetal; resins of ketone group, such as polyether ketone; resins of imide group, such as polyimide; resins of hydroxyl group, such as phenol resin; resins of ethyl group, such as polyethylene; resins of alkyl group, such as polypropylene, resins of epoxy group, such as epoxy resin; resins of amino group, such as melamine resin; resins of methylol group, such as xylene resin and the compound thereof; and, further, ceramics, such as silicon dioxide, silicon nitride and the compound thereof.

As the material for the separation wall, it is desirable to use the resin having excellent resistance to heat, resistance to solvent, and good formability, which is represented by the engineering plastics in recent years, such as polyethylene, polypropylene, polyamide, polyetylene terephthalate, melamine resin, phenol resin, epoxy resin, polybutadiene, polyurethane, polyether etherketone, polyethersulfone, polyarylate, polyimide, polysulfone, liquid crystal polymer (LCP), and the compound thereof or silicon dioxide, silicon nitride, nickel, gold, stainless steel, or some other metal, alloy and the compound thereof, or those coated with titanium or gold on the surface thereof.

Also, the thickness of the separation wall may be determined in consideration of the material, shape, and some other requirement from the viewpoint of the strength good enough for the separation wall to serve its purpose, and also, of the operativity good enough for the movable member to attain its function, but it is desirable to set the thickness at approximately 0.5 μm to 10 μm.

For the present example, the width of the slit 35 for the formation of the movable member 31 is set at 2 μm. However, if the bubbling liquid and the discharge liquid are different ones, and the mixture thereof should be prevented, the width of the slit may be set at a gap good enough to form meniscus between these liquids, while controlling the distribution of the liquids themselves, respectively. If, for example, liquid of approximately 2 cP (centipoise) is used as the bubbling liquid, and liquid of 100 cP or more is used as the discharge liquid, it is possible to prevent them from being mixed with the provision of a slit of approximately 5 μm. However, it is desirable to set the width of the slit at 3 μm or less. For the present example, it is objected to arrange the thickness of the movable member to be in the μm order (t μm), and it is not intended to use any movable member whose thickness is in the cm order. As the movable member whose thickness is in the μm order, it is desirable to take into consideration some inconsistency in the manufacture thereof if the slit width should be in the μm order (W μm).

Now, in the case where the thickness of the free end of the movable member having the slit formed on it and/or the thickness of the member that faces the side ends thereof, and the thickness of the movable member are the same (see FIG. 17 or the like), it becomes possible to suppress the mixture of the bubbling liquid and the discharge liquid stably by establishing the relationship between the width and thickness of the slit within a range given below in consideration of the anticipated inconsistency of its manufacture. This is a limited condition, but as the design consideration, the structure can be arranged to suppress the mixture of these two kinds of liquids for a long time by satisfying the $W/t \leqq 1$, provided that a highly viscous ink (5 cp, 10 cp, or the like) is used with the bubbling liquid whose viscosity is 3 cp or less.

As described above, when the functional separation is established as to the bubbling liquid and the discharge liquid, the movable member essentially serves as the partitioning member for them. Then, when the movable member shifts following the development of bubble, it is observable that a small amount of the bubbling liquid is mixed with the discharge liquid. The discharge liquid with which to form images is usually the one which contains the colorant of approximately 3% to 5% density for ink jet recording. With this in view, there is no significant change in density even if the bubbling liquid is mixed with the discharge liquid within a range of 20% or less. Thus, the mixture of the bubbling liquid is 20% or less against the discharge liquid is assumed to be included in the present example.

Here, in accordance with the present example, the mixture of bubbling liquid of 15% is encountered at the maximum even when the viscosities are changed. With the bubbling liquid of 5 cps or less, the mixture of approximately 10% is the maximum, although this percentage of mixture depends on driving frequencies. When the viscosity of the discharge liquid is made as low as 20 cps or less, the mixture is reduced to 5% or less, for example.

(Elemental Substrate)

Figure 20A:
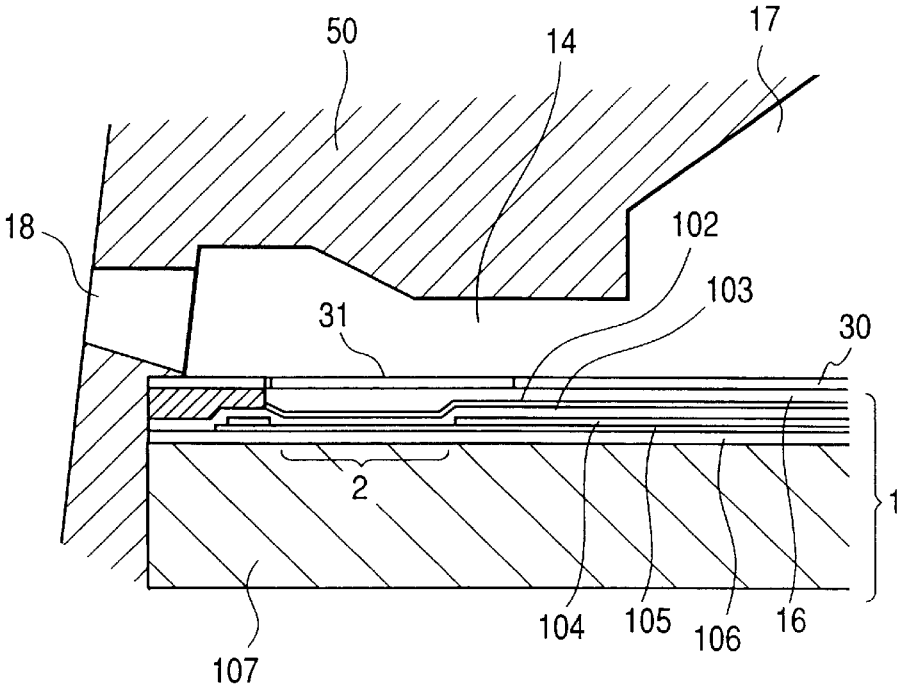
FIGS. 20A and 20B are vertically sectional views which illustrate the liquid discharge head.
Figure 20B:
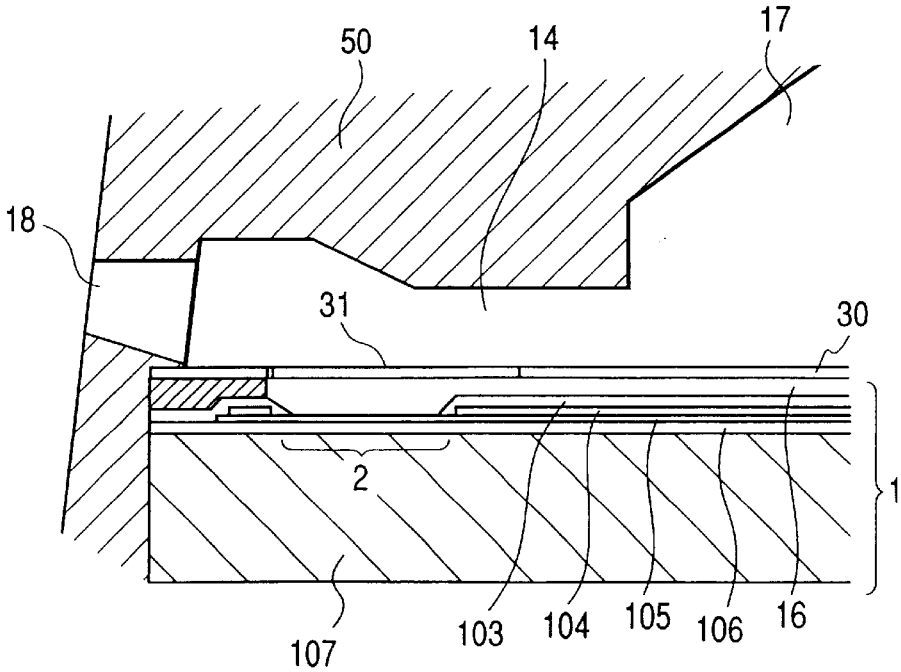

Now, the description will be made of the structure of the elemental substrate having the heat generating members arranged on it to give heat to liquid. FIGS. 20A and 20B are vertically sectional views which illustrate the liquid jet head of the present example. FIG. 20A shows the head which is provided with the protection film. FIG. 20B shows the one without the protection film.

On the elemental substrate 1, there are arranged the second flow paths 16, the separation wall 30, the first flow paths 14, and the ceiling plate 50 which is provided with the grooves that constitute the first liquid flow paths, respectively. On the elemental substrate 1, the silicon oxide film or the silicon nitride film 106 is formed for the substrate 107 using silicon or the like for the purpose of insulation and heat accumulation. On this film, the electric resistive layer 105 (0.01 to 0.2 $\mu$m thick) formed by hafnium boride ($HfB_2$), tantalum nitride (TaN), tantalum aluminum (TaAl), or the like, and the wiring electrodes of aluminum or the like (0.2 to 1.0 $\mu$m thick) are patterned as shown in FIG. 13. With these two wiring electrodes 104, voltage is applied to the resistive layer 105 to energize it for heating. On the resistive layer between the wiring electrodes, the protection layer is formed by silicon oxide, silicon nitride, or the like in a thickness of 0.1 to 2.0 $\mu$m. Further on that, the anticavitation layer formed by tantalum or the like (0.1 to 0.6 $\mu$m thick) is filmed to protect the resistive layer 105 from ink or various other liquids.

Particularly, the pressure and impulsive waves generated at the time of bubbling and bubble disappearance of bubble are extremely strong, which affect the durability of the hard but brittle oxide film and make it considerably lowered. Therefore, metallic material, such as tantalum (Ta), is used for the anticavitation layer.

Also, by the combination of the liquid, the liquid flow path structure, and the resistive material, a structure may be arranged without any protection layer provided for the aforesaid resistive layer. Such example is shown in FIG. 20B. For the material used for the resistive layer that does not need any protection layer, an alloy of iridium-tantalum-aluminum may be cited, among some others. In this way, the structure of the heating member may be formed only with the resistive layer (heating member) between the electrodes. Also, it may be possible to provide the protection layer that protects the resistive layer.

Here, for the present example, it is arranged to use the heat generating member which is structured with the resistive layer which gives heat in accordance with the electric signals, but the heat generating member is not necessarily limited to it. It should be good enough if only the heat generating member can create bubble in bubbling liquid, which is good enough to discharge the discharge liquid. For example, it may be possible to use the heat generating member having the optothermal converting element that gives heat when receiving laser or other beams or having the heating unit that gives heat when receiving high frequency.

Here, for the aforesaid elemental substrate 1, it may be possible to incorporate, in the semiconductor manufacturing process, the transistors, diodes, latches, shift registers, or some other functional elements integrally for driving the electrothermal transducing devices selectively, besides the electro-thermal transducing devices each of which is formed by the resistive layer 105 to constitute the heating unit as described earlier, and the wiring electrodes 104 to supply electric signals to such resistive layer.

Figure 21:
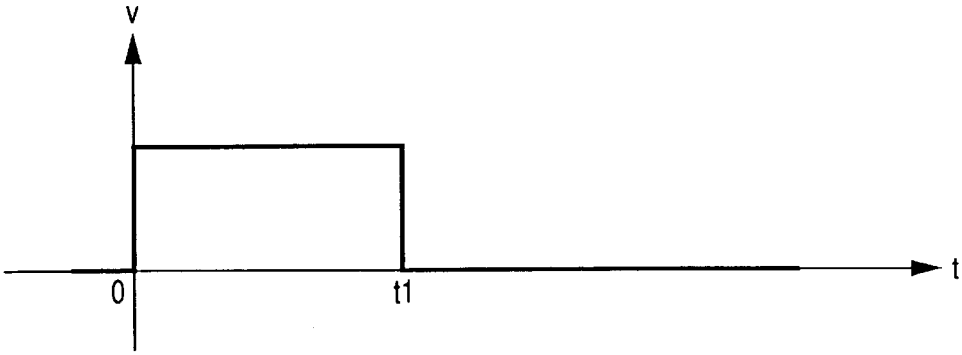
FIG. 21 is a view which schematically shows the shape of driving pulses.

Also, in order to discharge liquid by driving the heating unit of the electrothermal transducing devices arranged for the elemental substrate 1 as described above, the rectangular pulse as shown in FIG. 21 is applied to the resistive layer 105 though the wiring electrodes 104 to cause the resistive layer 105 to be heated abruptly between the wiring electrodes. For the head of each of the examples described earlier, the heat generating member is driven by the application of the voltage at 24V, the pulse width approximately in 7 $\mu$sec, the current of approximately 150 mA, and the electric signals at 6 kHz or more. Then, ink which serves as the liquid is discharged from each of the discharge ports by the operation which has described earlier. However, the condition of the driving signal is not necessarily limited to it. It should be good enough if only the driving signal can bubble the bubbling liquid appropriately.

(Discharge Liquid and Bubbling Liquid)

As described earlier for previous examples, it is possible for this example to discharge liquid with the discharge power and efficiency higher than the convention liquid discharge head, and also, at higher speeds, with the structure provided with the movable member. When the same kind of liquid is used for the bubbling and discharging by the application of some of the examples described, it is possible to make the reversible change of states of vaporization and condensation by the application of heat without any deterioration by heat given by the heat generating member and any deposition on the heat generating member by the application of heat. Further, it is possible to use various kinds of liquids as far as the liquid to be used does not cause the liquid flow paths, movable members, and separation wall to be deteriorated. Of the various liquids, it is possible to use as the liquid for use of recording (recording liquid) the ink of the composition usable by the conventional bubble jet apparatus.

Meanwhile, when different kinds of liquids are used as the discharge liquid and the bubbling liquid by use of the two-flow path head of the present example, it should be good enough to use the liquid having the properties described earlier. More specifically, it is possible to cite methanol, ethanol, n-propanol, isopropanol, n-hexane, n-heptan, n-oxtan, toluene, xylene, methylene dioxide, trichlene, Freon TF, Freon BF, ethylether, dioxane, cyclohexane, methyl acid, ethyl acid, acetone, methylethyl ketone, water, or the like, and compounds thereof.

As the discharge liquid, it is possible to use various liquids irrespective of the presence or absence of the bubbling property or the thermal property. Also, it is possible to utilize the liquid having a lower bubbling capability; the one whose property is easily changeable or deteriorated by the application of heat; or the highly viscose liquid, among some others, which cannot be used conventionally with ease. However, it is desirable to not to use any liquid which tends to impede, as the nature of the discharge liquid itself or as its property, such operation as discharging, bubbling, and the movement of the movable member.

As the discharge liquid for recording use, it is possible to utilize the highly viscose ink or the like. Besides, such liquid as medicine or perfume which is weak against head can also be utilized as other discharge liquid. As one example, the recording is made by use of the recording liquid having the following composition as the one adoptable both for discharging and bubbling. With the enhancement of the discharge power, the discharge speed of ink is made faster, hence obtaining recorded images in an extremely fine condition with the improved impact accuracy of the liquid droplets.

Composition of color ink (viscosity 2 cP)

| | |
|---|---|
| (C-1, Food black 2) color | 3 wt % |
| diethylene glycol | 10 wt % |
| thiodiglycol | 5 wt % |
| ethanol | 5 wt % |
| water | 77 wt % |

Also, recording is performed by use of the liquids having the following compositions in combination for bubbling and discharging. As a result, it becomes possible to discharge in good condition the extremely high viscous liquid of 150 cP, which can hardly be discharged by use of the conventional head, not to mention the one whose viscosity is 10 cP, hence obtaining recorded objects in high image quality.

The composition of the bubbling liquid 1

| | |
|---|---|
| ethanol | 40 wt % |
| water | 60 wt % |

The composition of the bubbling liquid 2 water 100 wt %

The composition of the bubbling liquid 3

| | |
|---|---|
| isopillalcohl | 10 wt % |
| water | 90 wt % |

Discharge liquid 1

The composition of color ink (viscosity 15 cP)

| | |
|---|---|
| carbon black | 5 wt % |
| styrene-acrylic acid-acrylic acid ester copolymer | 1 wt % |

(acid value 140, wt mean molecular weight 8000)

| | |
|---|---|
| monoethanol amine | 0.25 wt % |
| glycerine | 69 wt % |
| thiodiglycol | 5 wt % |
| ethanol | 3 wt % |
| water | 16.75 wt % |

The composition of discharge liquid 2 (viscosity 55 cP)

polyethylene glycol 200 100 wt %

The composition of discharge liquid 3 (viscosity 55 cP)

polyethylene glycol 600 100 wt %

Now, in the case of the liquid which cannot be discharged easily in accordance with the conventional art as described earlier, the discharge speed becomes slower to promote the inconsistency of the discharge orientation, and the accuracy with which the dots are impacted on the recording sheet becomes inferior. Also, the discharge amount varies due to the unstable discharges. As a result, it is difficult to obtain high quality images. With the structure arranged as the above example, the creation of bubbles can be made sufficiently and stably by use of the bubbling liquid. Therefore, it is possible to implement the enhancement of the impact accuracy of the liquid droplets, and the stabilization of the discharge amount of ink. Thus, the quality of recorded images is significantly improved.

(Liquid Discharge Head Cartridge)

Now, the description will be made of the liquid discharge head cartridge on which is mounted the liquid discharge head of the examples described above.

Figure 23:
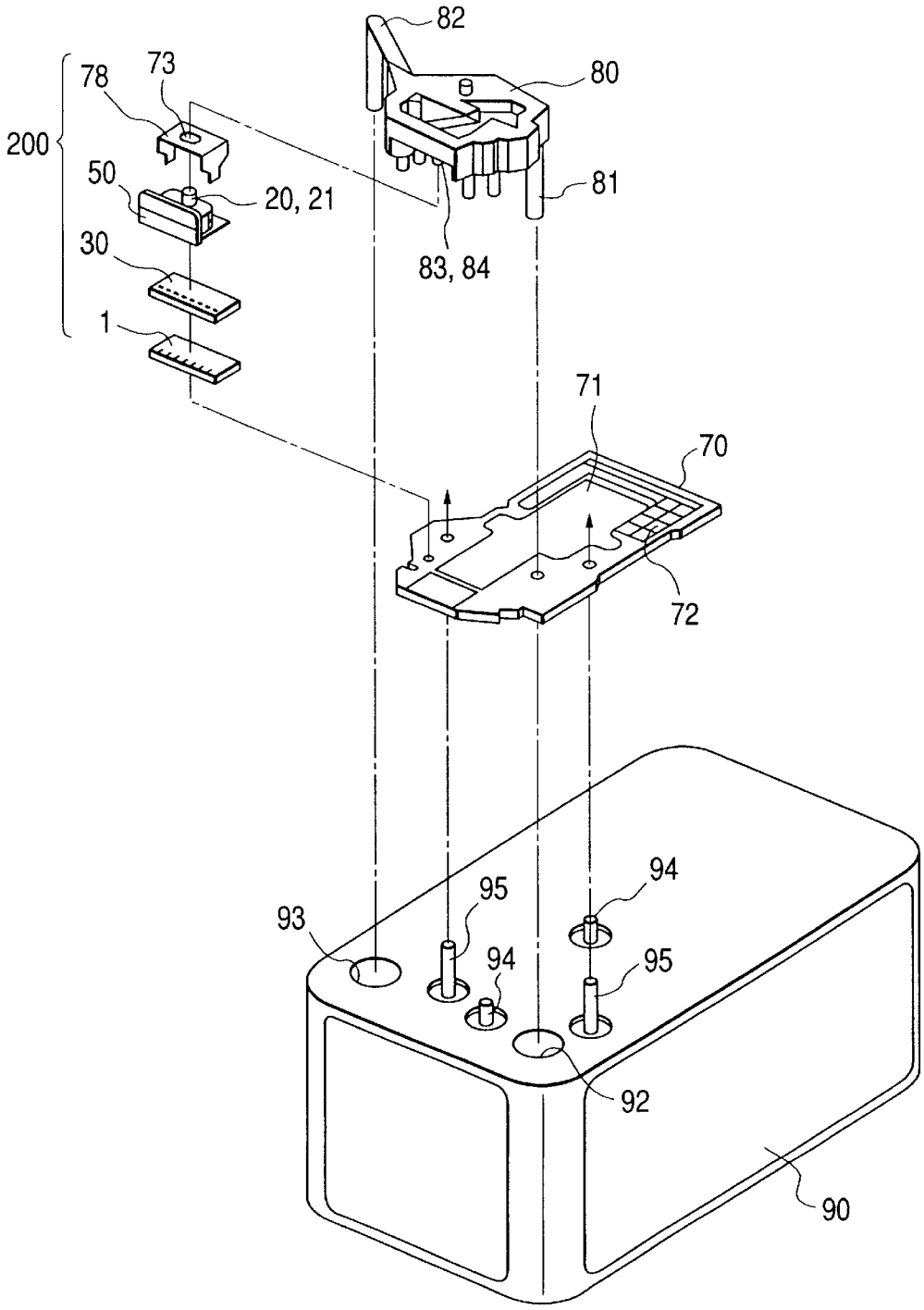
FIG. 23 is an exploded perspective view which shows a liquid discharge head cartridge.

FIG. 23 is an exploded perspective view which schematically shows the liquid discharge head cartridge that includes the liquid discharge head described earlier. The liquid discharge head cartridge is structured mainly by the liquid discharge head unit 200 and the liquid container 90.

The liquid discharge had unit 200 comprises an elemental substrate 1, a separation wall 30, a grooved member 50, a pressure spring 78, a liquid supply member 80, and a supporting member 70, among some others. For the elemental substrate 1, a plurality of heating generating resistors that apply heat to the bubbling liquid as described earlier are arranged in line. Also, a plurality of functional members are arranged to selectively drive these heat generating resistors. Between the elemental substrate 1 and the separation wall 30 having the movable members on it, the bubbling liquid paths are formed, and the bubbling liquid is distributed. When the separation wall 30 and the grooved member 50 are joined together, the discharge flow paths (not shown) are formed where the discharge liquid are distributed for discharging.

The pressure spring 78 is a member to bias the grooved member 50 in the elemental substrate 1 direction. By this biasing force, the elemental substrate 1, the separation wall 30, the grooved member 50, and the supporting member 70 which will be described later are put together in good condition. The supporting member 70 is a member to support the elemental substrate 1 and others. On this supporting member 70, there are arranged a circuit board 71 connected with the elemental substrate 1 to supply electric signals, and the contact pads 72 to exchange electric signals with the apparatus side when it is connected with the apparatus.

The liquid container 90 contains the discharge liquid, such as ink, to be supplied to the liquid discharge head, and the bubbling liquid to create bubbles separately in the interior thereof. For the outer side of the liquid container 90, the positioning member 94 is provided to arrange the connecting member to connect the liquid discharge head and the liquid container. Here, the fixing shaft 95 is also provided to fix the connecting portion. The discharge liquid is supplied from the discharge liquid supply path 92 of the liquid container to the discharge liquid supply path 81 of the liquid supply member 80 through the supply path of the connecting member, and then, supplied to the first common liquid chamber through the discharge liquid supply paths 83, 73, and 20 of the respective members. Likewise, the bubbling liquid is supplied from the supply path 93 of the liquid container to the bubbling liquid supply path 82 of the liquid supply member 80 through the supply path of the connecting member, and then, supplied to the second liquid chamber through the bubbling liquid supply paths 84, 73, and 21 of the respective members.

For the liquid discharge head cartridge thus structured, the description has been made of the supply mode and the liquid container capable of making supply when the bubbling liquid and the discharge liquid are different ones. However, if the discharge liquid and the bubbling liquid are the same kind of liquid, it may be unnecessary to separate the containers and supply paths each for the bubbling liquid and the discharge liquid, respectively.

In this respect, it may be possible to arrange so that the liquid container is made usable again with each of the liquids to be refilled after consumption. It is then desirable to provide a liquid injection port for the liquid container. Also, it may be possible to form the liquid discharge head and the liquid container integrally as one body or to make them separable.

(The Liquid Discharge Apparatus)

Figure 24:
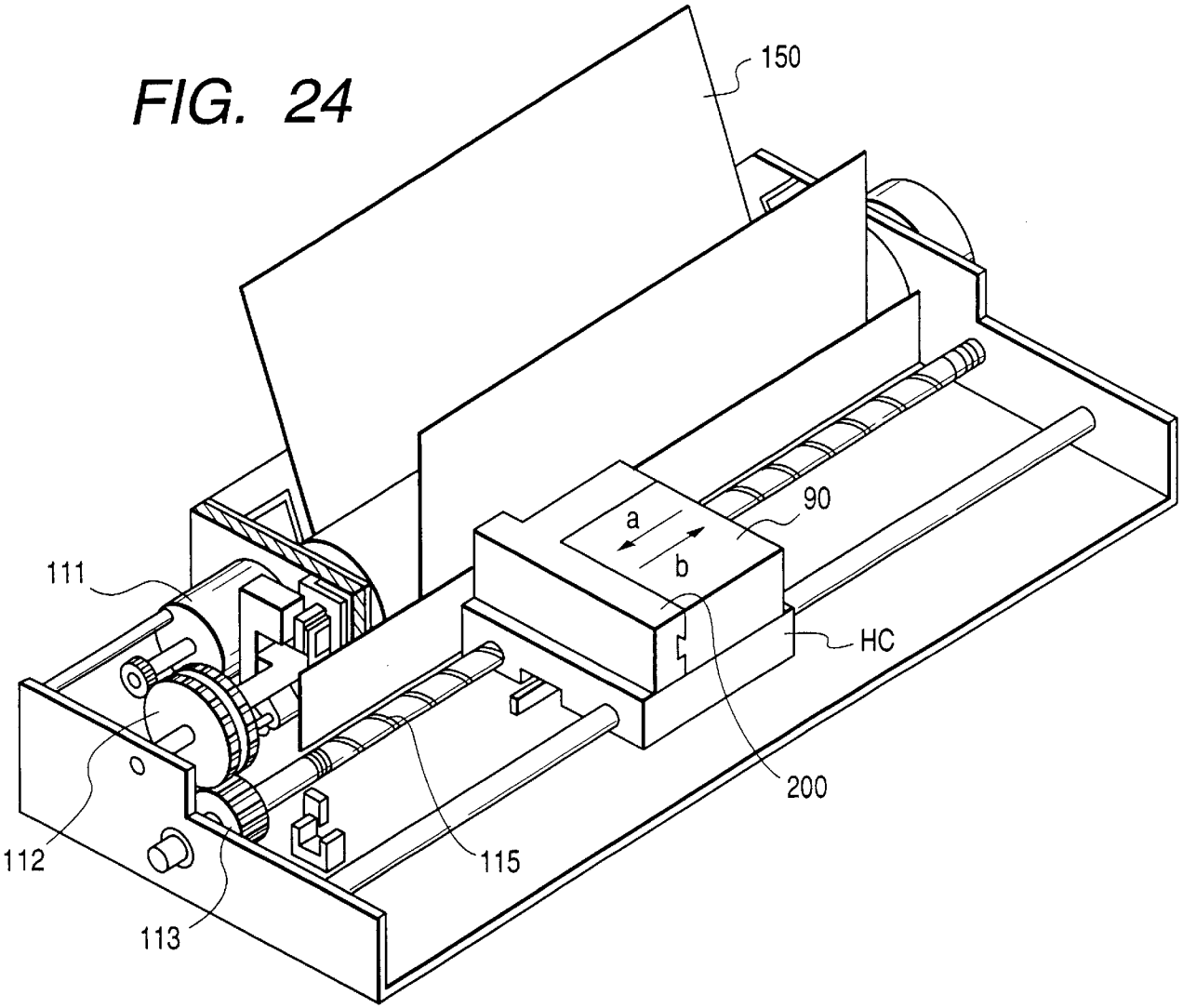
FIG. 24 is a perspective view which shows the principle part of a liquid discharge apparatus.

FIG. 24 is a perspective view which schematically shows the principal part of the liquid discharge apparatus having the liquid discharge head described earlier mounted on it. Particularly, for the present example, the description will be made of an ink jet recording apparatus that uses ink as the discharge liquid. The carriage HC of the liquid discharge apparatus is arranged to mount on it the head cartridge on which the liquid tank unit 90 that contains ink, and the liquid discharge head unit 200 are detachably mounted. The carriage can reciprocate in the width direction of the recording medium 150, such as a recording sheet, which is carried by means for carrying the recording medium. When driving signals are supplied from driving signal supplying means (not shown) to liquid discharge means on the carriage, the recording liquid is discharged from the liquid discharge head to the recording medium in accordance with the driving signals.

Also, in accordance with the liquid discharge apparatus of the present example, there are provided the motor 111 serving as the driving source to drive the recording medium carrying means, as well as to drive the carriage; the gears 112 and 113 that transmit the driving power from the driving source to the carriage; and the carriage shaft 115, among some others. With this recording apparatus and the liquid discharge method adopted for the recording apparatus, it is possible to obtain recorded objects in good images by discharging liquid onto various kinds of recording media.

Figure 25:
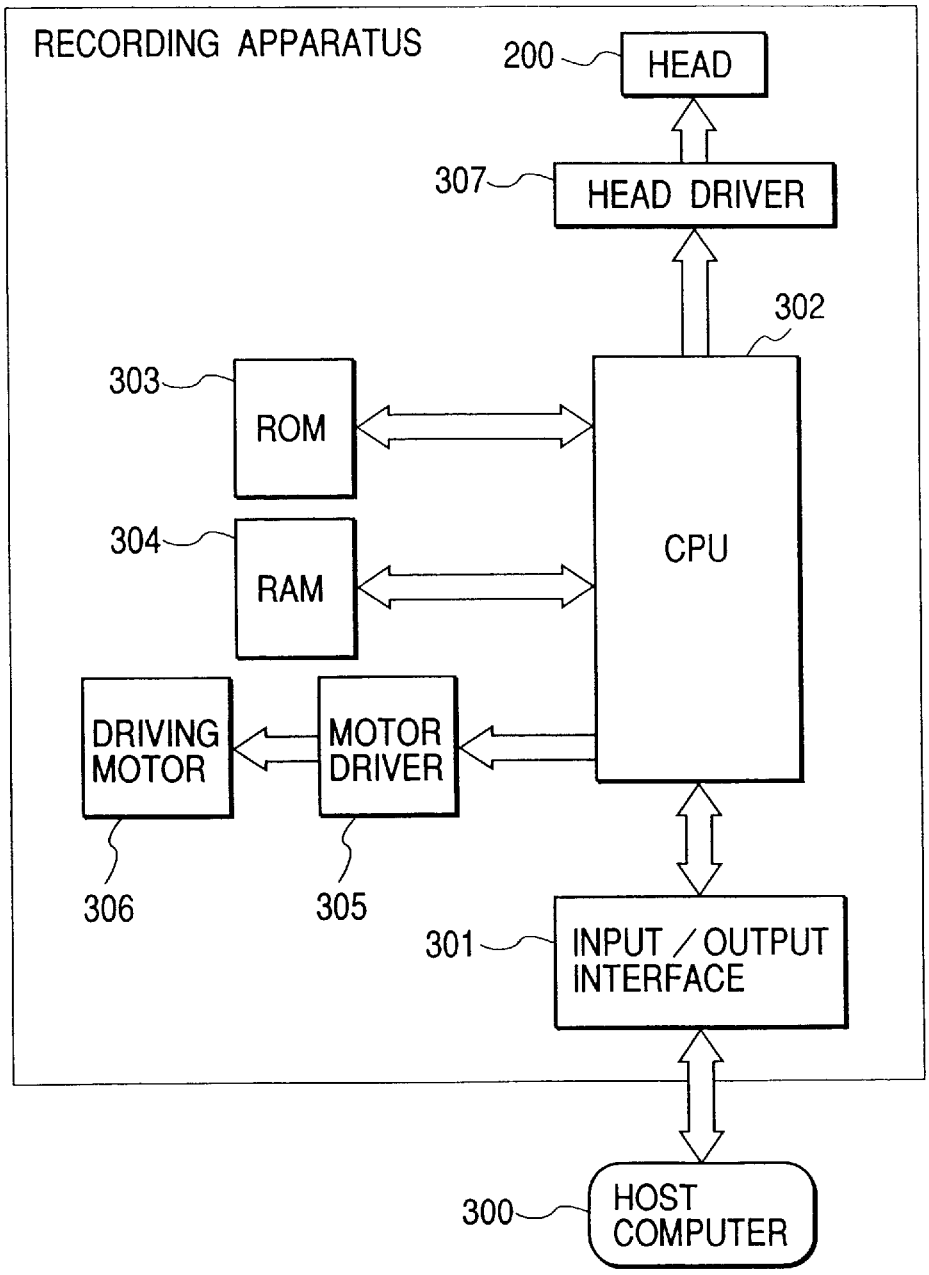
FIG. 25 is a block diagram which shows the liquid discharge apparatus.

FIG. 25 is a block diagram of the apparatus main body for operating the ink discharge recording by use of the liquid discharge method and liquid discharge head of the present invention.

The recording apparatus receives the printing information from the host computer 300 as the control signals. The printing information is provisionally held on the input interface 301 in the interior of the printing device, and at the same time, converted into the data to be processed in the recording apparatus, which are inputted into the CPU 302 which dually functions as means for supplying the head driving signals. The CPU 302 processes the data inputted into the CPU 302 by use of the RAM 304 and other peripheral devices in accordance with the control program stored on the ROM 303, hence converting them into the data (image data) used for printing.

Also, the CPU 302 produces the driving data for driving the driving motor which enables the recording medium and the recording head to shift in synchronism with the image data in order to record the image data on the appropriate positions on the recording medium. The image data and the motor driving data are transferred to the head 200 and the driving motor 306 through the head driver 307 and the motor driver 305, hence forming images by use of the head and the motor to be driven by the controlled timing, respectively.

As the recording medium which is applicable to the recording apparatus described above for the provision of ink or other liquid on it, there are various paper and OHP sheets, the plastic material usable for compact discs and ornamental boards, textile cloth, aluminum, copper, or some other metallic material, the leather material such as cowhide, pigskin, or artificial leather, wood material, such as woods, plywood, bamboo, ceramic material, such as tiles, and sponge or other three-dimensionally structured objects, among some others.

Also, as the recording apparatus described above, there are a printing apparatus that records on various paper and OHP sheets or the like; the recording apparatus for use of plastics to recording on the plastic material, such as compact discs; the recording apparatus for use of metals to record on the metallic plates; the recording apparatus for use of leathers to recording on them; the recording apparatus for use of woods to record on them; the recording apparatus for use of ceramics to record on ceramic materials; the recording apparatus for recording on sponge or some other three-dimensionally netted objects. Here, also, the textile printing apparatus is included for recording on cloths or the like. Also, as discharge liquid used for each of these liquid discharge apparatuses, it should be good enough to use the liquid which is suitable for the respective recording media and recording conditions.

(Recording System)

Now, the description will be made of one example of the ink jet recording system that uses the liquid discharge head of the present invention for recording on a recording medium.

Figure 26:
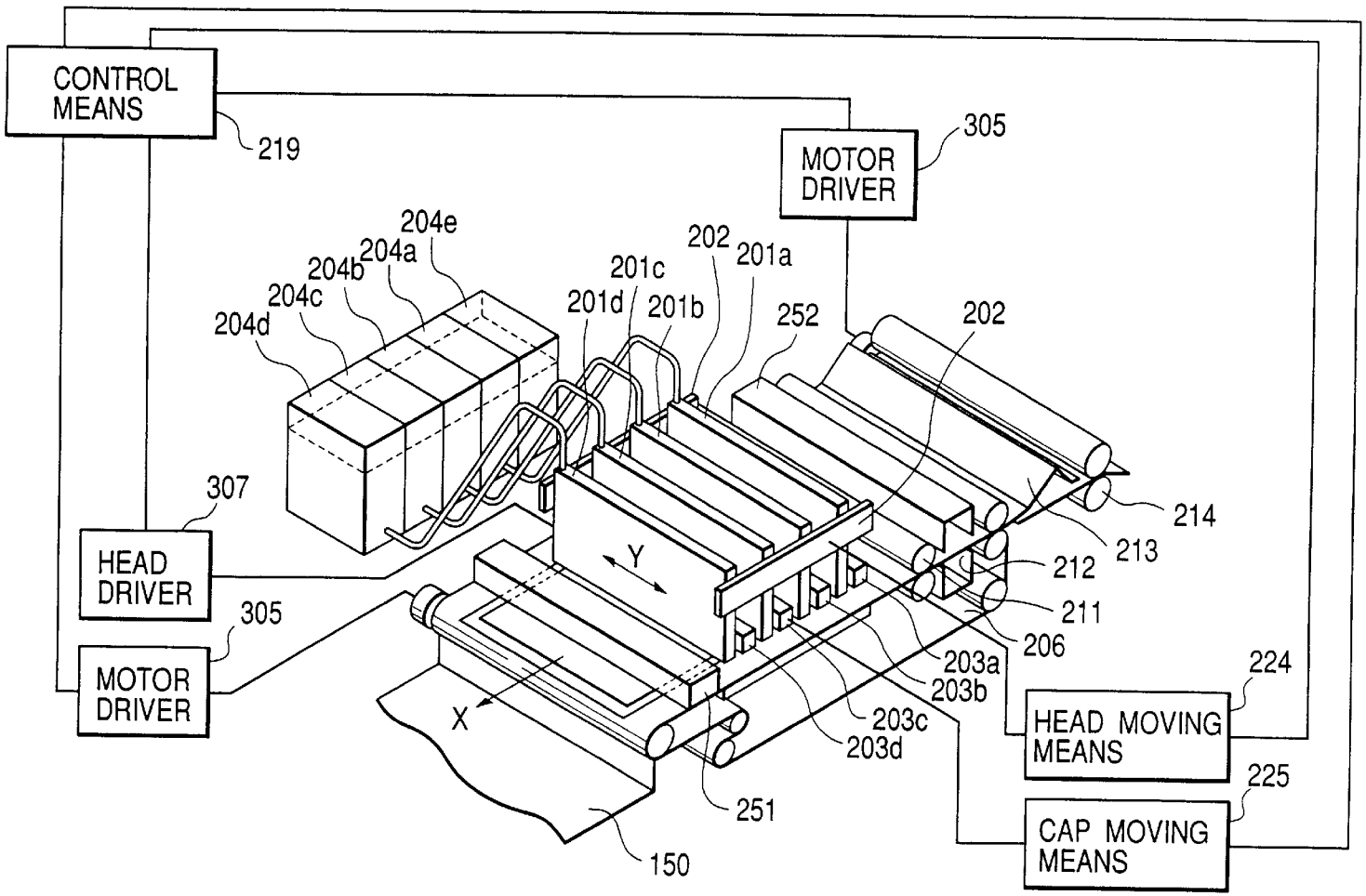
FIG. 26 is a perspective view which shows the system of the liquid discharge recording.
Figure 27A:
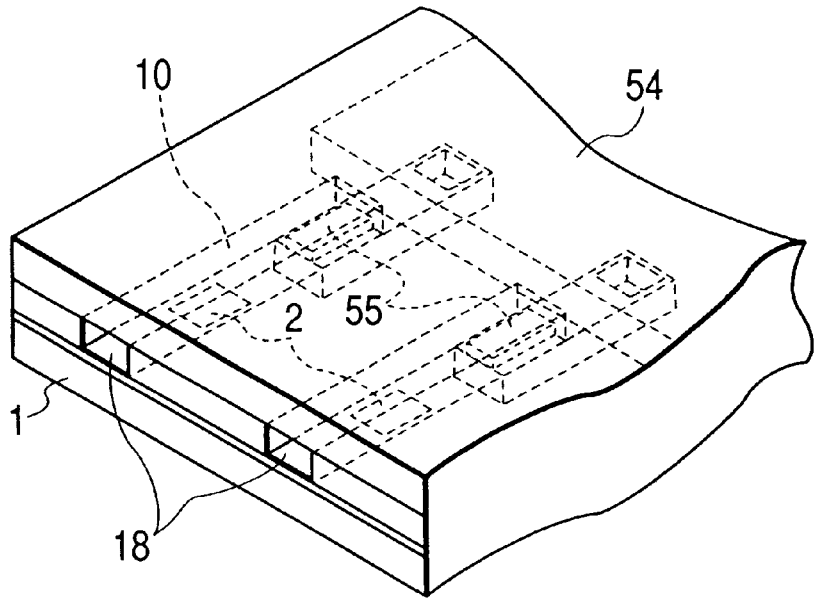
FIGS. 27A and 27B are views which illustrate the liquid flow path structure of the conventional liquid discharge head.
Figure 27B:
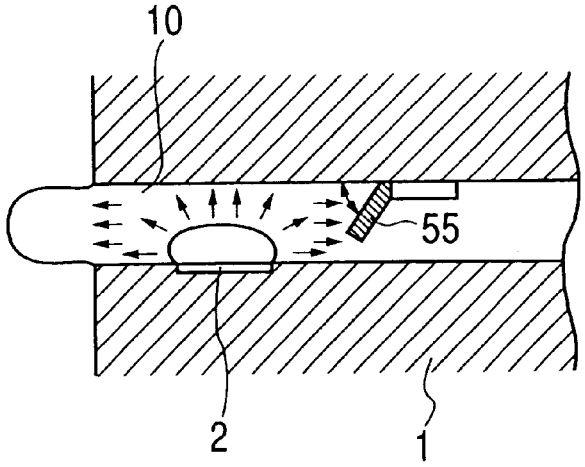

FIG. 26 is a perspective view which shows the ink jet recording system that uses the liquid discharge heads 201*a* to 201*d* of the present invention described earlier. In this example, each of the liquid discharge heads is of full line type having a plurality of discharge ports arranged at the intervals of 360 dpi in a length corresponding to the recordable width of a recording medium 150, and the four heads used for yellow (Y), magenta (M), cyan (C), and black (Bk), respectively, are fixedly supported by the holder 202 in the direction X at a specific interval between them in parallel to each other. Here, the head holder 202 is connected with head traveling means 224.

To each of these heads, signals are supplied from the head driver 307 that constitutes each of driving signal supply means. In accordance with the signals thus supplied, each of the heads is driven. As discharge liquids, each ink of four colors Y, M, C, and Bk is supplied from the respective ink containers 204*a* to 204*d* to each of the heads. In this respect, a reference numeral 204*e* designates the bubbling liquid container having bubbling liquid in it. Then, the structure is arranged to supply bubbling liquid from this container to each of the heads.

Also, underneath each head, each of the head caps 203*a* to 203*d* is arranged with an ink absorbent, such as sponge, contained in it. Then, at the time of non-recording, the discharge ports of each head is capped by use of cap movement means 225 to maintain each of the heads.

A reference numeral 206 designates the carrier belt that constitutes carrier means for carrying various kinds of recording media described in conjunction with the previous examples. The carrier belt 206 is tensioned around various rollers or the like 211 to 213 via a specific route, which is driven by the driving roller 214 connected with the motor driver 305. The motor driver 305, the head driver 307, head traveling means 224, and cap movement means are connected with the control circuit 219.

For the ink jet recording system of the present example, there are arranged the pre-processing device 251 and the post-processing device 252, which perform various processes for the recording medium 150 before and after recording, on the upstream and downstream of the recording medium carrying path, respectively. The pre-processing and post-processing are different in the content of each process depending on the kinds of recording medium and ink with which recording is performed. For example, when a recording medium of metal, plastics, or ceramics is used, the irradiation of ultraviolet rays and ozone is given as the pre-processing to activate the surface of the recording medium, hence implementing the enhancement of ink adhesion thereto. Also, for the recording medium which is subjected to the generation of static electricity, such as plastics, an ionizer device is used for the pre-processing to remove the static electricity generated on the recording medium for cleaning off dust particles from the recording medium, because dust particles tend to adhere to the surface thereof due to the static electricity, and in some case, such dust particles may hinder the performance of recording in good condition. Also, when textile cloth is used as a recording medium, the pre-processing may be performed to provide a substance, which is selected from among alkaline substance, water soluble substance, synthetic polymer, water-soluble metallic salt, urea, and thiourea, for the textile medium form the viewpoint of preventing ink spread, enhancing the ratio of the first arrival of ink, or the like. The pre-processing is not necessarily limited to those exemplified here. It may be possible to give a heat treatment or the like to make the temperature of the recording medium appropriate at the time of recording. On the other hand, the post-processing is such as the fixing process to promote the fixation of ink by means of heat treatment or ultraviolet irradiation on the recording medium for which ink has been provided or the cleaning process to clean off the processing agent provided in the pre-processing but still remaining unreacted or the like.

Here, for this example, the description has been made of the case where the full line head is used, but the present invention is not necessarily limited to the use of this head. It is also applicable to the mode in which a small-sized head as described earlier is used for recording by carrying it in the width direction of a recording medium.

EMBODIMENTS

Figure 22:
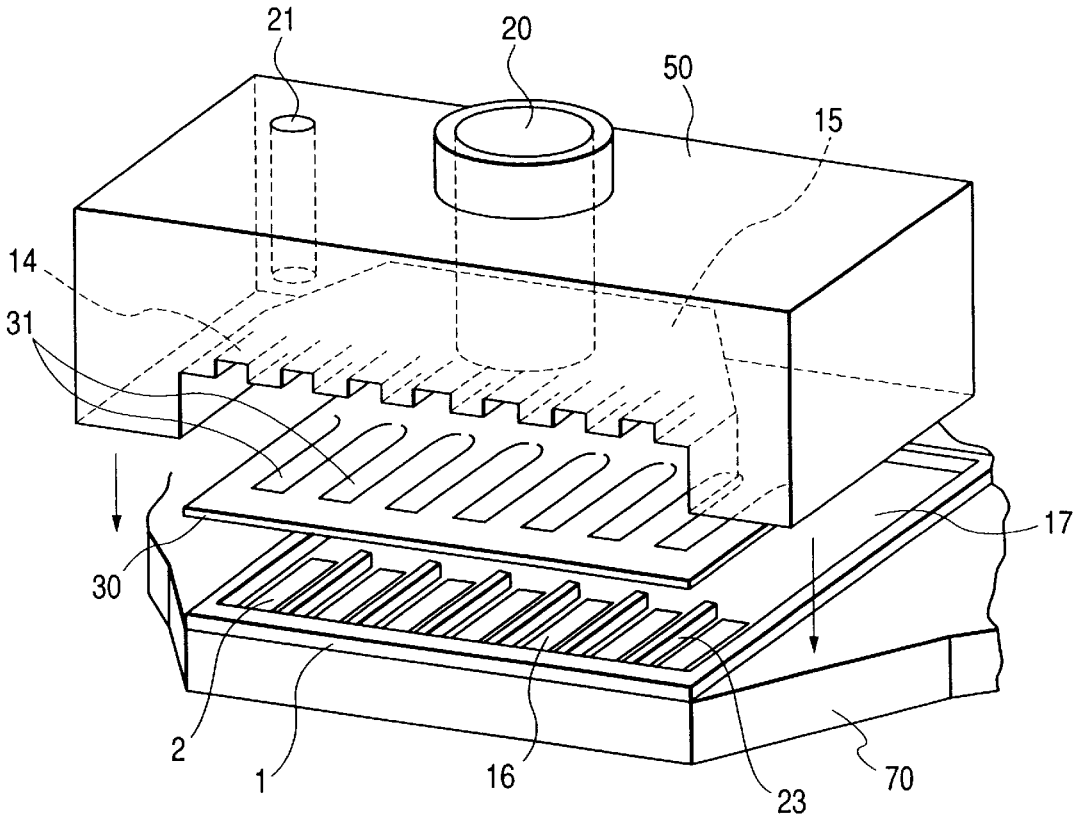
FIG. 22 is an exploded perspective view which shows the liquid discharge head.

Now, with reference to the accompanying drawings, the embodiments will be described in accordance with the present invention. For the embodiments given below, too, the main discharge principles of liquid discharge are the same as the description which has been made above. Here, the present invention is applied to the two-flow path head described above. FIG. 22 is an exploded perspective view which shows the typical two-flow path head.

As shown in FIG. 22, the elemental substrate 1 is arranged on the supporting member 70 formed by aluminum or the like. On the substrate, there are arranged the heat generating members 2, the second flow path walls 23 of the second liquid flow path 16, and the walls of the second common liquid chamber 17. Then, the separation wall 30 is arranged on it with the movable members 31. Further, on the separation wall 30, there are arranged a plurality of grooves that form the first liquid flow paths 14, the first common liquid chamber 15, the supply path 20 to supply the first liquid to the first common liquid chamber 15, and the grooved member 50 having the supply path formed to supply the second liquid to the second common liquid chamber 17. With these members, the two-flow path head is structured.

First Embodiment

Figure 1:
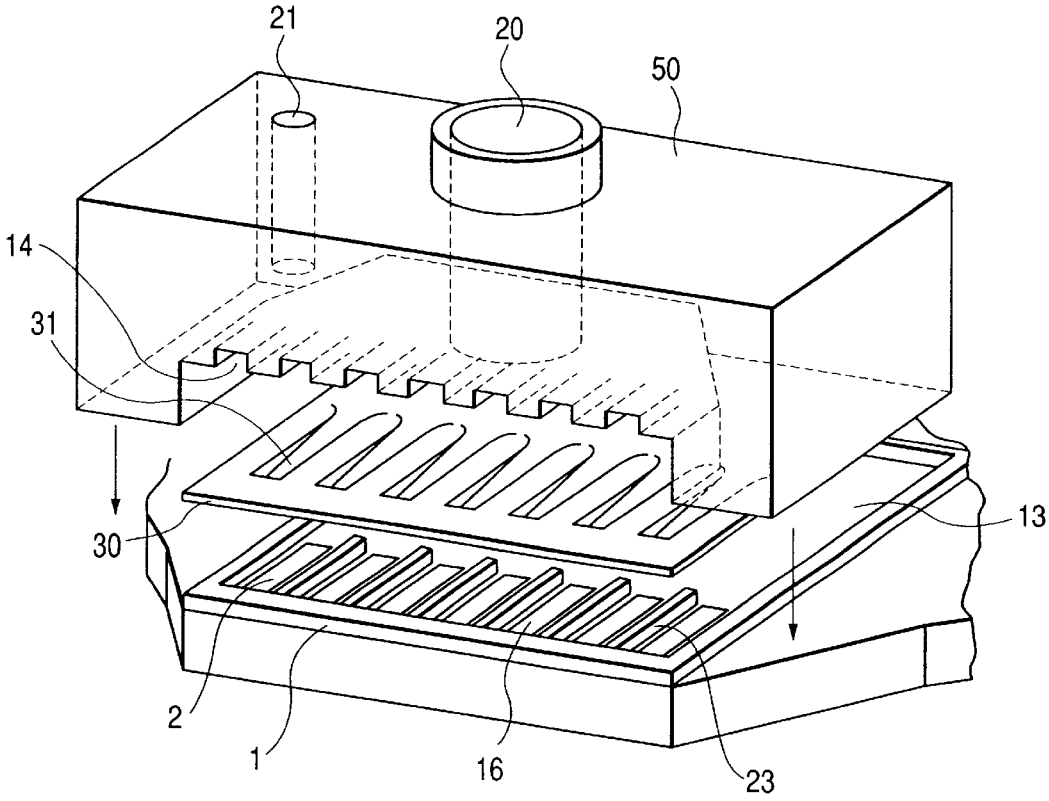
FIG. 1 is a exploded perspective view which shows the liquid discharge head in accordance with a first embodiment of the present invention.
Figure 2A:
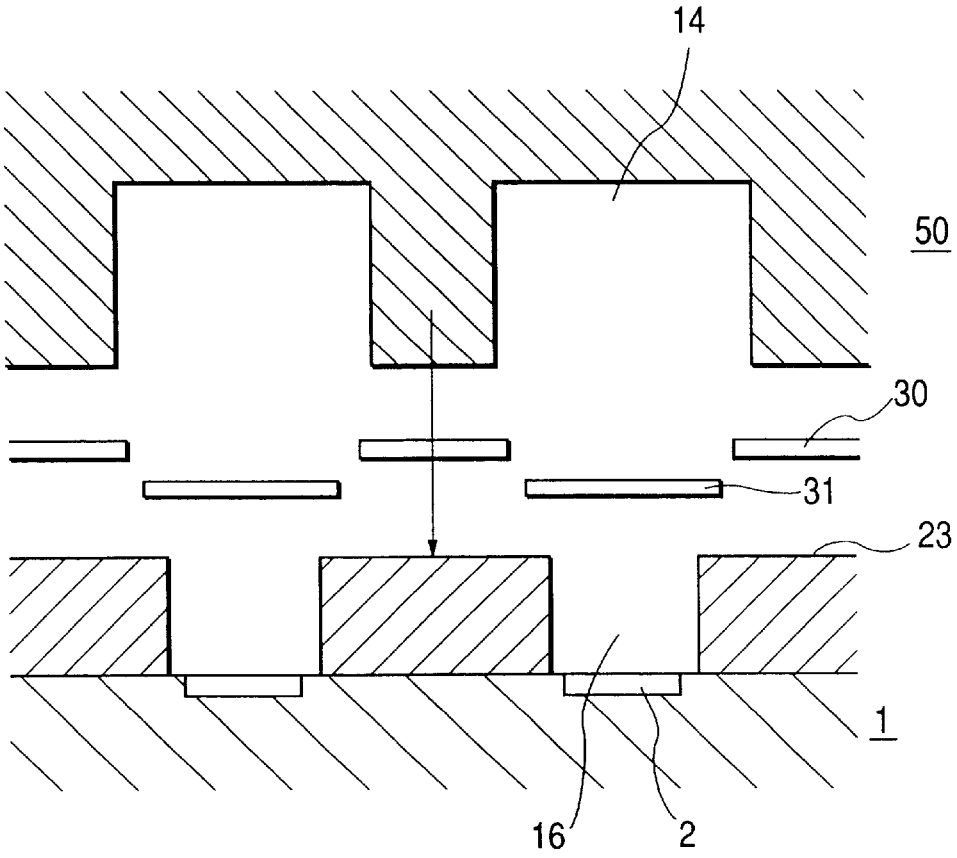
FIGS. 2A and 2B are views which illustrate a separation wall provided with a movable member in accordance with the first embodiment of the present invention.
Figure 2B:
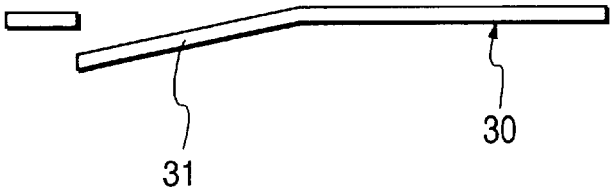

FIG. 1 is an exploded perspective view which shows the liquid discharge head in accordance with a first embodiment of the present invention. The structure of this head is the same as the two-flow path head shown in FIG. 22 with the exception of the structure of the separation wall. FIGS. 2A and 2B are views which illustrate a separation wall provided with a movable member in accordance with the first embodiment of the present invention: FIG. 2A is an exploded sectional view which illustrates the positioning and fixing processes of the separation wall; and FIG. 2B is a side view showing the separation wall.

As shown in FIG. 2A, this head is manufactured by positioning, bonding and fixing the separation wall 30 having each of the bending movable member 31, the grooved member 50 having grooves that become the first liquid flow paths 14, and the elemental substrate 1 provided with the heater board having grooves which become the heat generating members 2 and the second liquid flow paths 16. As shown in FIG. 1 and FIGS. 2A and 2B, each movable member 31 provided for the separation wall 30 is bent to the heat generating member side (the second flow path side) at the fulcrum of the movable member 31 as the bending point in order to exert its own stress.

For the head of the present embodiment, the movable member 31 is bent to the heat generating member side. Therefore, the movable member 31 interrupts the opening portion of the first liquid flow path 14 and the second liquid flow path 16, and at the same time, closes under pressure the covering portion of the movable member 31 and the second liquid flow path wall 23 by means of its own stress. In this way, since the movable member is bent in advance, there is no need for changing the conventional structure, hence presenting an advantage in costwise.

Second Embodiment

Figure 3:
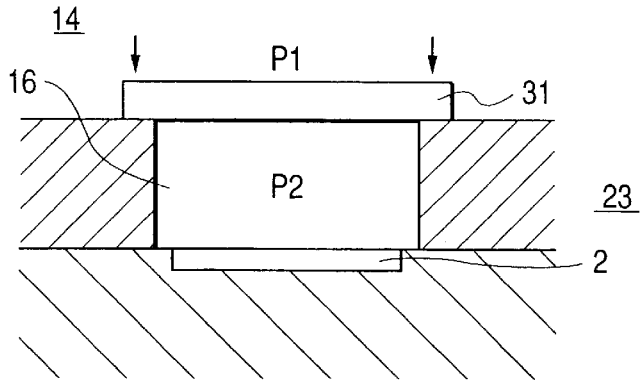
FIG. 3 is a cross-sectional view which shows the covering state presented by the movable member of the liquid discharge head in accordance with a second embodiment of the present invention.

FIG. 3 is a cross-sectional view which shows the covering state by the movable member of the liquid discharge head in accordance with a second embodiment of the present invention.

As shown in FIG. 3, the pressure P1 of the first liquid flow path 14 is always made higher than the pressure P2 of the second liquid flow path 16. Then, with this difference in pressure (the water head of the discharge liquid—the water head of the bubbling liquid), the covering portion of the movable member 31 and the second liquid flow path wall 23 is pressurized.

For the head of the present embodiment, it is possible to apply weighting uniformly on the movable member entirely by means of the difference in pressure. Therefore, the covering capability of the covering portion is enhanced. Also, the pressure exerted on the covering portion can be modified easily by changing the difference in pressure.

Third Embodiment

Figure 4A:
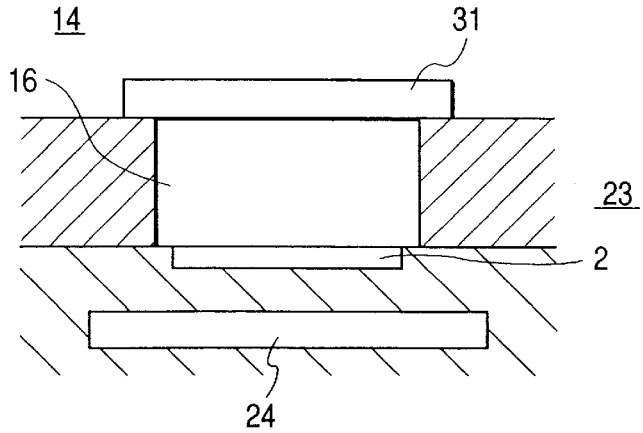
FIGS. 4A and 4B are views which illustrate the covering state presented by the movable member of the liquid discharge head in accordance with a third embodiment of the present invention.
Figure 4B:
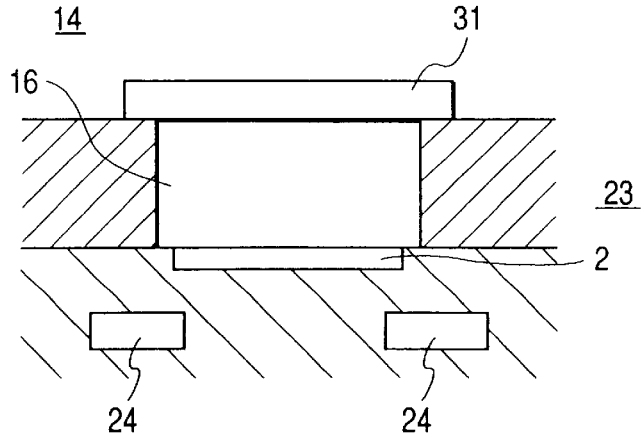

FIGS. 4A and 4B are cross-sectional views which illustrate the covering state of the movable member of the liquid discharge head in accordance with a third embodiment of the present invention. FIG. 4A shows the example in which the magnet 24, which is magnetic force generating member, is arranged below the heat generating member 2 over the entire area in the width direction of the movable member 31. FIG. 4B shows the example in which the magnet 24 is arranged only immediately below the interrupting portion. In the latter case, it is arranged so that the influence of the magnetic force is exerted on the area which does not overlaid with the interrupting portion of the movable member 31.

As shown in FIGS. 4A and 4B, the movable member 31 is attracted by the magnet 24 to the second liquid flow path wall 23 to close the covering portion under pressure. Here, the movable member 31 is formed by the material which can react to the magnetic force.

The head of the present embodiment is allowed to press the covering portion by use of the magnet 24. As a result, the magnetic force becomes weaker at the time of discharge, because the movable member 31 is displaced to make the distance from the magnet 24 greater, and the interrupting capability becomes higher at the time of non-discharge, because the distance from the magnet is made smaller. The present embodiment is particularly suitable for the pressurized closing of the covering portion by attracting the movable member 31 to the second liquid flow path wall 23 by applying the magnetic force when the head is left intact. Here, if the electromagnetic valve or the like is used as the magnet 24 to make its on and off possible, the opening and closing can be controlled for the opening portion of the first liquid flow path 14 and the second liquid flow path 16.

Forth Embodiment

Figure 5A:
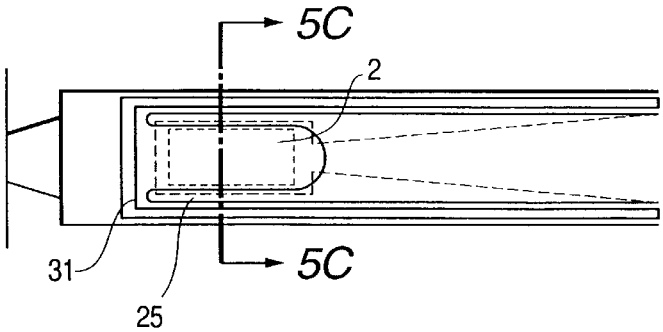
FIGS. 5A, 5B and 5C are views which illustrate the liquid discharge head in accordance with a fourth embodiment of the present invention.
Figure 5B:
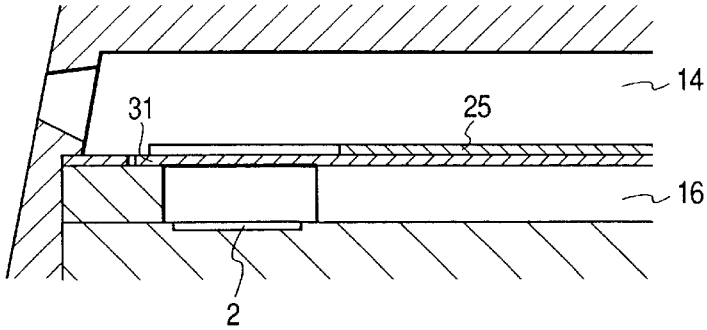
Figure 5C:
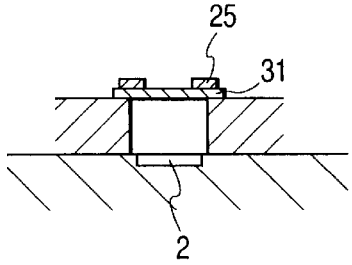

FIGS. 5A to 5C are views which illustrate the liquid discharge head in accordance with a fourth embodiment of the present invention: FIG. 5A is an upper surface view showing one flow path of the head; FIG. 5B is a cross-sectional view in the flow path direction thereof; and FIG. 5C is a cross-sectional view, taken along line 5C—5C in FIG. 5A.

As shown in FIGS. 5A to 5C, a pressure member 25 is arranged on the movable member 31 (the side opposite to the heat generating member 2) to press the interrupting portion. The central portion of the leading end side of the pressure member 25 is cut off and configured to press only the interrupting portion.

The head of the present embodiment can intensively press only the interrupting portion by use of the pressure member 25, but not on the movable member entirely. Also, it does not exert any significant influence on the robustness and displacing configuration of the movable member 31. Therefore, with this arrangement, the conventional movable members can be utilized.

Fifth Embodiment

Figure 6A:
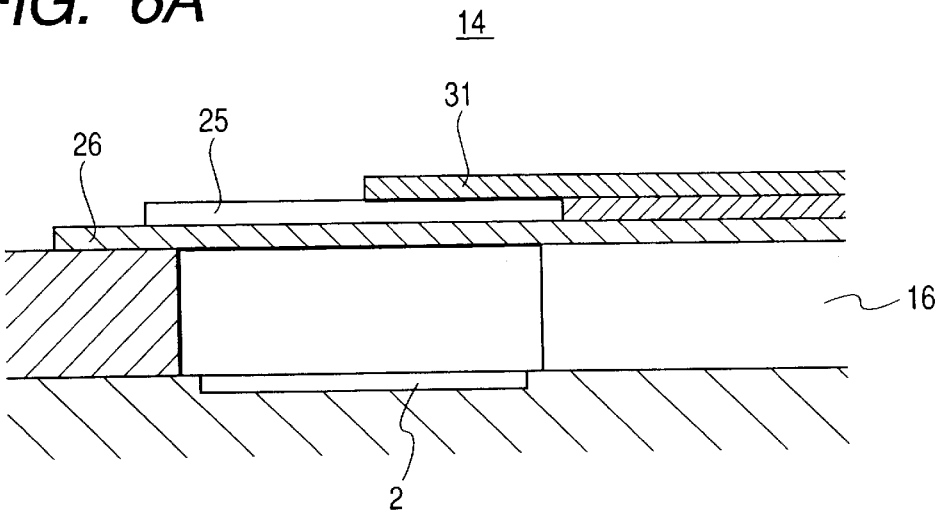
FIGS. 6A, 6B and 6C are views which illustrate the liquid discharge head in accordance with a fifth embodiment of the present invention.
Figure 6B:
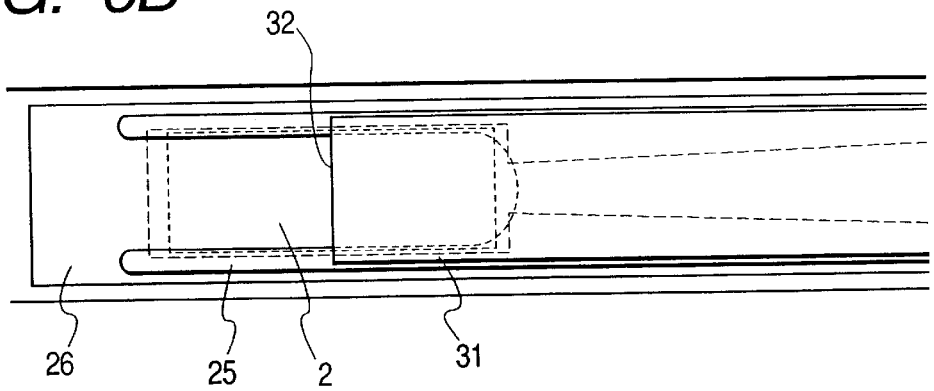

FIGS. 6A and 6B are views which illustrate the liquid discharge head in accordance with a fifth embodiment of the present invention: FIG. 6A is the side sectional view showing one flow path of the head and FIG. 6B is the upper surface view thereof.

For the present embodiment, the movable member of the head of the fifth embodiment, which is structured as shown in FIGS. 5A to 5C, is replaced with the sealing member 26, and then, the movable member 31 is arranged on the pressure member 25.

It is required for the sealing member 26 to interrupt the opening portion of the first liquid flow path 14 and the second liquid flow path 16 as much as possible even when it is displaced due to bubbling. Therefore, this member is made larger than the opening portion. The robustness of the sealing member 26 is made as small as approximately 1/100 of the robustness of the pressure member 25. With the extremely small robustness of the sealing member 26 thus provided, this member can respond to the pressure of bubble quickly, and it is closed faster at the time of bubble disappearance, for example. As in the fourth embodiment, the pressure member 25 is configured to press only the interrupting portion. Also, the movable member 31 is structured so as not to place its free end 32 on the discharge port side of the interrupting portion, because it is needed to direct the bubbling pressure to the discharge port side positively.

The head of the present embodiment make it possible to optimize the separation effect on the discharge liquid and the bubbling liquid, and also, optimize the discharge effect, respectively, because the sealing member 26 is made functional to be used for separating the opening portion of the first liquid flow path 14 and the second liquid flow path 16 so as to enable the movable member 31 to function as the enhancement use of the discharge efficiency.

Figure 6C:
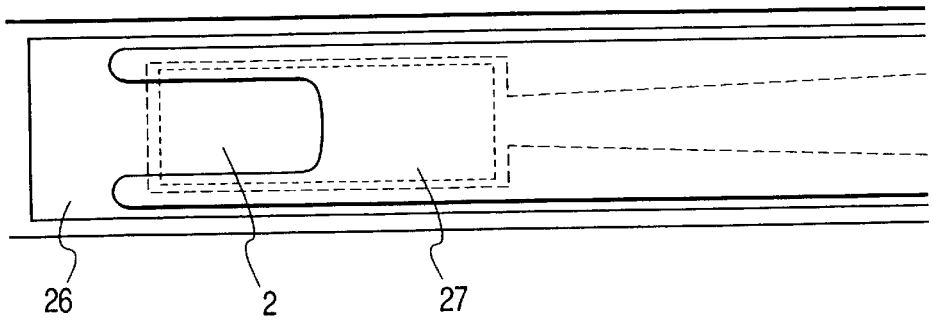

Here, as the variational example of the present embodiment, it may be possible to integrate the pressure member 25 and the movable member 31 as shown in FIG. 6C so that the movable member 27 is made operative together with the pressurizing function.

Sixth Embodiment

Figure 7:
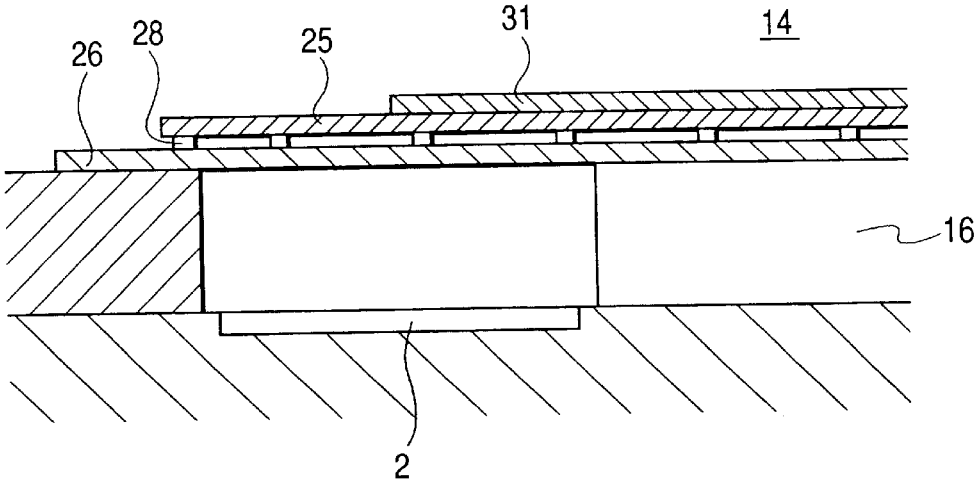
FIG. 7 is a side sectional view which shows the liquid discharge head in accordance with a sixth embodiment of the present invention.
Figure 8A:
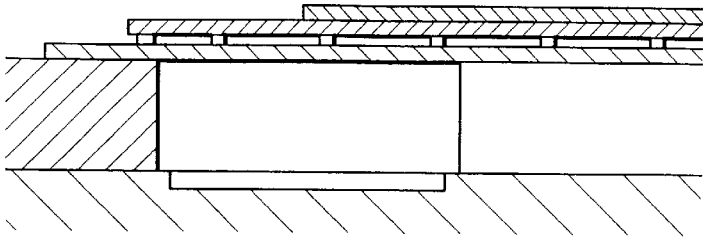
FIGS. 8A, 8B, 8C and 8D are side sectional views which illustrate the operation of the liquid discharge head represented in FIG. 7.
Figure 8B:
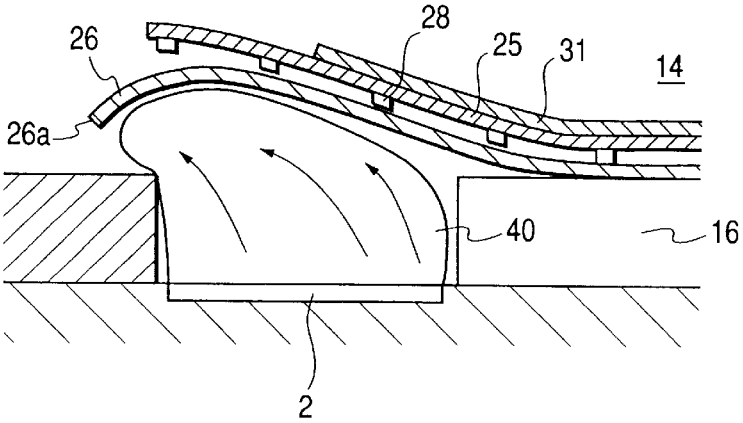
Figure 8C:
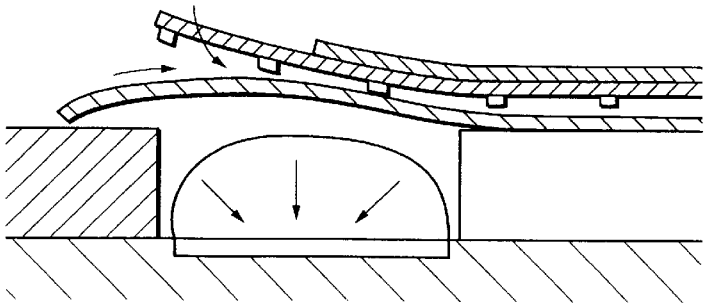
Figure 8D:
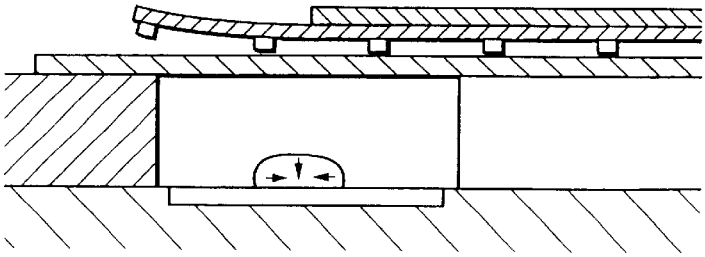

FIG. 7 is a side sectional view which shows the liquid discharge head in accordance with a sixth embodiment of the present invention. FIGS. 8A to 8D are side sectional views which illustrate the operation of the liquid discharge head shown in FIG. 7.

As shown in FIG. 7, in accordance with the present embodiment, the protrusions 28 are arranged on the sealing member side of the pressure member 25 of the head of the fifth embodiment so as not to allow the sealing member 26 and the pressure member 15 to be closely in contact with each other. The protrusions 28 are arranged in the area which is in contact with the covering portion through the pressure member 25, and press the covering portion by spots.

Now, in conjunction with FIGS. 8A to 8D, the operation of the head will be described.

(a) In the initial state, the sealing member 26 which has a smaller robustness is pressed by the protrusions 28 of the pressure member 25.

(b) When the bubble is created, the sealing member 26, the pressure member 25, and the movable member 31 begin to be displaced. The bubble 40 is directed in the discharge direction by the function of the movable member 31. Also, the with the smaller robustness, the sealing member 26 is deformed following the shape of the bubble 40, and the displacement of the free end 26*a* is smaller.

(c) At the time of bubble disappearance, the discharge liquid entire between the sealing member 26 and the pressure member 25 through the gaps between the protrusions 28. The sealing member 26 is not allowed to be closely in contact with the pressure member 25, and it reacts upon the pressure of the bubble 40 quickly so as to cover the opening portion of the first liquid flow path 14 and the second liquid flow path 16 earlier than the pressure member 25 and the movable member 31.

(d) The pressure member 25 and the movable member 31 return to the initial state later than the sealing member 26.

The head of the present embodiment makes it possible to satisfy both the separating function of the sealing member 26 with the respect to the first liquid flow path 14 and the second liquid flow path 16, and the enhancing function of the discharge efficiency of the movable member 31, because of the separation of the sealing member 26 and the pressure member 25 by use of the protrusions 28.

Here, for the head shown in FIG. 6C, which is the variational example of the sixth embodiment, it is possible to obtain the same effect when the protrusions are arranged on the sealing member side of the movable member provided with the pressurizing function.

The "movable member" and the "sealing member" described in the above embodiments are called the "displacement member" collectively in the specification hereof.

What is claimed is:

1. A liquid discharge head comprising:

a discharge liquid flow path communicating with a discharge port for discharging discharge liquid to enable the discharge liquid to flow;

a bubbling liquid flow path to enable bubbling liquid to flow, said bubbling liquid flow path being provided with a bubble generating area for creating a bubble used for discharging the discharge liquid from said discharge port;

a separation member for separating said discharge liquid flow path from said bubbling liquid flow path, said separation member being provided with an opening portion positioned to face said bubble generating area; and a displacement member provided for said separation member corresponding to said opening portion, having a free end which is displaced by the bubble created on said bubble generating area, said displacement member being bent for self-stress even when no bubble is created on said bubble generating area, wherein when no bubble is created on said bubble generating area, said displacement member shuts said opening portion by contacting a portion of said separation member peripheral to at least a portion of said opening portion, and when the bubble is created on said bubble generating area, said free end of said displacement member is displaced to discharge the discharge liquid from said discharge port.

2. A liquid discharge head according to claim 1, wherein when no bubble is created on said bubble generating area, said displacement member is held shut.

3. A liquid discharge head according to claim 1, wherein a heat generating member is arranged for said bubble generating area to generate thermal energy to be utilized for creating the bubble.

4. A liquid discharge head according to claim 1, wherein the discharge liquid and the bubbling liquid are different from each other.

5. A liquid discharge head according to claim 1, wherein said displacement member is substantially in the form of a rectangle, one side of the rectangle being made as a fixed end and the other three sides being made displaceable, and wherein, when no bubble is created on said bubble generating area, all of the three displaceable sides shut said opening portion.

6. A head cartridge comprising:

a liquid discharge head provided with a discharge liquid flow path communicating with a discharge port for discharging discharge liquid to enable the discharge liquid to flow, a bubbling liquid flow path to enable bubbling liquid to flow, said bubbling liquid flow path being provided with a bubble generating area for creating a bubble used for discharging the discharge liquid from said discharge port, a separation member for separating said discharge liquid flow path from said bubbling liquid flow path, said separation member being provided with an opening portion positioned to face said bubble generating area, and a displacement member provided for said separation member corresponding to said opening portion, having a free end which is displaced by the bubble created on said bubble generating area, said displacement member being bent for self-stress even when no bubble is created on said bubble generating area; and a liquid container for containing the discharge liquid and the bubbling liquid to be supplied to said liquid discharge head, wherein when no bubble is created on said bubble generating area, said displacement member shuts said opening portion by contacting a portion of said separation member peripheral to at least a portion of said opening portion, and when a bubble is created on said bubble generating area, the free end of said displacement member is displaced by the bubble to discharge the discharge liquid from said discharge port.

7. A liquid discharge apparatus comprising:

a liquid discharge head provided with a discharge liquid flow path communicating with a discharge port for discharging discharge liquid to enable the discharge liquid to flow, a bubbling liquid flow path to enable bubbling liquid to flow, said bubbling liquid flow path being provided with a bubble generating area for creating a bubble used for discharging the discharge liquid from said discharge port, a separation member for separating said discharge liquid flow path from said bubbling liquid flow path, said separation member being provided with an opening portion positioned to face said bubble generating area, and a displacement member provided for said separation member corresponding to said opening portion, having a free end which is displaced by the bubble created on said bubble generating area, said displacement member being bent for self-stress even when no bubble is created on said bubble generating area; and a carriage for mounting said liquid discharge head thereon, wherein when no bubble is created on said bubble generating area, said displacement member shuts said opening portion by contacting a portion of said separation member peripheral to at least a portion of said opening portion, and when a bubble is created on said bubble generating area, the free end of said displacement member is displaced by the bubble to discharge the discharge liquid from said discharge port.

8. A method for discharging liquid comprising the following steps of:

providing a liquid discharge head provided with a discharge liquid flow path communicating with a discharge port for discharging discharge liquid to enable the discharge liquid to flow, a bubbling liquid flow path to enable bubbling liquid to flow, the bubbling liquid flow path being provided with a bubble generating area for creating a bubble used for discharging the discharge liquid from the discharge port, a separation member for separating the discharge liquid flow path from the bubbling liquid flow path, the separation member being provided with an opening portion positioned to face the bubble generating area, and a displacement member provided for the separation member corresponding to the opening portion by contacting a portion of said separation member peripheral to at least a portion of said opening portion, having a free end which is displaced by the bubble created on the bubble generating area, the displacement member being bent for self-stress even when no bubble is created on said bubble generating area, and shutting the opening portion when no bubble is created on the bubble generating area; and discharging the discharge liquid form the discharge port by creating the bubble on the bubble generating area to displace the free end of the displacement member by the bubble.

* * * * *